US008167304B2

(12) United States Patent
Fukazawa et al.

(10) Patent No.: US 8,167,304 B2
(45) Date of Patent: May 1, 2012

(54) PAPER SHEET DIVERTER, PAPER SHEET PROCESSING APPARATUS AND PAPER SHEET DIVERTING METHOD

(75) Inventors: Masaaki Fukazawa, Himeji (JP); Toshihiko Kobayashi, Himeji (JP); Tsuguo Mizoro, Himeji (JP); Hisayuki Utsumi, Himeji (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 0 days.

(21) Appl. No.: 12/733,630

(22) PCT Filed: Jun. 18, 2008

(86) PCT No.: PCT/JP2008/061093

§ 371 (c)(1),
(2), (4) Date: Mar. 10, 2010

(87) PCT Pub. No.: WO2009/034758

PCT Pub. Date: Mar. 19, 2009

(65) Prior Publication Data

US 2010/0213661 A1 Aug. 26, 2010

(30) Foreign Application Priority Data

Sep. 12, 2007 (JP) ..... 2007-236653

(51) Int. Cl.
*B65H 5/00* (2006.01)

(52) U.S. Cl. ..... 271/225

(58) Field of Classification Search ..... 271/225, 271/3.19, 297, 305, 902, 303; 209/534
See application file for complete search history.

(56) References Cited

U.S. PATENT DOCUMENTS

| | | | | |
|---|---|---|---|---|
| 4,871,163 | A | 10/1989 | Landa et al. | |
| 4,925,178 | A * | 5/1990 | Clabbers et al. | 271/186 |
| 5,536,002 | A * | 7/1996 | Yoshida et al. | 271/264 |
| 6,286,831 | B1 * | 9/2001 | Marasco et al. | 271/303 |
| 6,394,446 | B1 * | 5/2002 | Okamoto | 271/186 |
| 6,398,212 | B1 * | 6/2002 | Miyake | 271/186 |

(Continued)

FOREIGN PATENT DOCUMENTS

EP 1 445 223 Al 8/2004

(Continued)

OTHER PUBLICATIONS

European Search Report corresponding to European Patent Application No. 08765710.2 (9 pages—dated Dec. 16, 2011).

*Primary Examiner* — Jeremy R Severson
(74) *Attorney, Agent, or Firm* — Renner, Kenner, Greive, Bobak, Taylor & Weber

(57) ABSTRACT

A diversion member 21 rotationally moves to at least three stopping positions including a first stopping position connecting a first transport path 11 and a second transport path 12 to form a first transport passage, a second stopping position connecting the first transport path 11 and a third transport path 13 to form a second transport passage and a third stopping position connecting transport paths other than the first transport path 11 to form a third transport passage. The rotation speed of the diversion member 21 between the first stopping position and the second stopping position is lower than that between the first stopping position and the third stopping position and that between the second stopping position and the third stopping position.

16 Claims, 28 Drawing Sheets

U.S. PATENT DOCUMENTS

| | | | | |
|---|---|---|---|---|
| 6,547,241 | B2 * | 4/2003 | Yoshida et al. | 271/303 |
| 7,708,276 | B2 * | 5/2010 | Okamoto et al. | 271/303 |
| 2003/0234487 | A1 * | 12/2003 | Tamura et al. | 271/303 |
| 2005/0179198 | A1 * | 8/2005 | Biegelsen et al. | 271/303 |

FOREIGN PATENT DOCUMENTS

| | | | |
|---|---|---|---|
| JP | 04-141468 | | 5/1992 |
| JP | 07-187470 | | 7/1995 |
| JP | 2742205 | | 1/1998 |
| JP | 3600762 | | 9/2004 |
| JP | 2005-179063 | | 7/2005 |
| JP | 3840365 | | 8/2006 |
| WO | WO 01/65493 | A2 | 9/2001 |
| WO | WO 01/65493 | A3 | 9/2001 |

* cited by examiner (a)

(b)

(a)

(b)

(c)

(a)

(b)

(a)

(b)

(a)

(b)

(a)

(b)

(c)

PAPER SHEET DIVERTER, PAPER SHEET PROCESSING APPARATUS AND PAPER SHEET DIVERTING METHOD

TECHNICAL FIELD

The present invention relates to a paper sheet diverter, paper sheet processing apparatus and paper sheet diverting method for switching transport paths for transporting paper sheets.

BACKGROUND ART

Conventionally, in a banknote processing unit such as a banknote depositing and dispensing unit for performing a depositing and dispensing process of banknotes, in order to transport paper sheets in multiple directions, a plurality of two-directional diverters are combined to constitute transport paths (see, for example, Patent Document 1). When a plurality of two-directional diverters are thus combined to constitute transport paths, the transport paths become complicated, the number of two-directional diverters is increased, thereby causing increases in occupying space, cost, etc.

On the other hand, a constitution is known that, in order to reduce the number of two-directional diverters, a plurality of two-directional diverters are integrated into a single diverter capable of diverting paper sheets in multiple directions.

For example, there exists a diverter in which a diversion member is rotatably provided at a junction portion of transport paths in three directions, so that the stopping position of the diversion member is controlled at three positions including, two positions forming transport passages connecting from the respective transport paths in two directions to the other transport path and one position forming a transport passage for bidirectionally transporting paper sheets between the transport paths in two directions (see, for example, Patent Document 2). In the diverter, only one diverter may be provided at a place where two two-directional diverters are required.

Additionally, there exists a diverter in which a diversion member is rotatably provided at a junction portion of transport paths which join to each other at an even angle in three directions, and a stopping position of the diversion member is controlled so that paper sheets can be bidirectionally transported between the transport paths in three directions. Transport faces for transporting paper sheets are formed at both sides of the diversion member used for the diverter. Both ends of the diversion member outside the transport face slightly taper off, but a portion constituting the transport face for transporting paper sheets is formed flat. That is, the transport faces of both sides are parallel to each other and formed relatively widely. The rotation angle of the diversion member between two stopping positions for switching two transport passages formed by one transport path and the two other transport paths is approximately 60°. The rotation angle of the diversion member between one of the two stopping positions for switching the two transport passages and the stopping position for switching to a transport passage connecting the two other transport paths other than the one transport path is also approximately 60°. Accordingly, the rotation angle of the diversion member for diverting paper sheets, which are transported from the one transport path, to the two other transport paths is approximately the same as that for switching to the transport passage other than the one transport path and is relatively large (see, for example, Patent Document 3). In the diverter, only one diverter may be provided at a place where three two-directional diverters are required.

Patent Document 1: Japanese Patent Publication No. 3600762 (pp. 6-7, FIG. 4)

Patent Document 2: Japanese Patent Publication No. 3840365 (pp. 3-4, FIGS. 1-3)

Patent Document 3: Japanese Patent Publication No. 2742205 (p. 2, FIG. 2)

DISCLOSURE OF THE INVENTION

Problems to be Solved by the Invention

However, in a diverter disclosed in Patent Document 2, paper sheets can be bidirectionally transported between only two specified transport paths in three directions, two-directional diverters are required to be combined with each other in order to bidirectionally transport paper sheets in multiple directions, and it is difficult to reduce the number of diverters.

Additionally, in a diverter disclosed in Patent Document 3, paper sheets can be bidirectionally transported between the transport paths in three directions. However, the rotation angle of the diversion member for diverting paper sheets, which are transported from the one transport path, to the two other transport paths is approximately the same as that of the diversion member for switching to transport passages other than the one transport path, and as it is relatively large, the diversion member takes a relatively long time to switch, thereby being unsuitable for diverting paper sheets, which are continuously transported from the one transport path, to the two other transport paths at high speed. Therefore, as the diverter is unsuitable for a place requiring high-speed diversion, two-directional diverters must be combined, and it is difficult to reduce the number of diverters.

The present invention has been made in view of the above problems and aims to provide a paper sheet diverter, paper sheet processing apparatus and paper sheet diverting method capable of diverting paper sheets in multiple directions with one diverter, responding to high-speed diversion of paper sheets, and reducing the number of diverters compared with that constituted by two-directional diverters.

Means to Solve the Problems

A paper sheet diverter according to one aspect of the invention includes: a diversion member which is rotatably provided at a junction portion of transport paths in at least three directions for transporting paper sheets; a driving unit for rotationally moving the diversion member; and a control unit for controlling the driving unit to make the diversion member rotationally move to at least three stopping positions including a first stopping position connecting a first transport path and a second transport path to form a first transport passage, a second stopping position connecting the first transport path and a third transport path to form a second transport passage and a third stopping position connecting transport paths other than the first transport path to form a third transport passage, and the rotation time of the diversion member between the first stopping position and the second stopping position is shorter than that between the first stopping position and the third stopping position and that between the second stopping position and the third stopping position.

The diversion member is rotationally moved to at least three stopping positions including the first stopping position connecting the first transport path and the second transport path to form the first transport passage, the second stopping position connecting the first transport path and the third transport path to form the second transport passage and the third stopping position connecting transport paths other than the first transport path to form the third transport passage, thereby paper sheets can be diverted in multiple directions by one paper sheet diverter. Further, the rotation time of the diversion member between the first stopping position and the second stopping position is shorter than that between the first stopping position and the third stopping position and that between the second stopping position and the third stopping position, thereby paper sheets transported from the first transport path can be diverted at high speed and the number of paper sheet diverters can be reduced compared with the case of two-directional diverters fulfilling such a diversion function.

A paper sheet diverter according to another feature of the invention includes: a diversion member which is rotatably provided at a junction portion of transport paths in at least three directions for transporting paper sheets; a driving unit for rotationally moving the diversion member; and a control unit for controlling the driving unit to make the diversion member rotationally move to at least three stopping positions including a first stopping position connecting a first transport path and a second transport path to form a first transport passage, a second stopping position connecting the first transport path and a third transport path to form a second transport passage and a third stopping position connecting transport paths other than the first transport path to form a third transport passage, and the rotation angle of the diversion member between the first stopping position and the second stopping position is smaller than that between the first stopping position and the third stopping position and that between the second stopping position and the third stopping position.

The diversion member is rotationally moved to at least three stopping positions including the first stopping position connecting the first transport path and the second transport path to form the first transport passage, the second stopping position connecting the first transport path and the third transport path to form the second transport passage and the third stopping position connecting transport paths other than the first transport path to form the third transport passage, thereby paper sheets can be diverted in multiple directions by one paper sheet diverter. Further, the rotation angle of the diversion member between the first stopping position and the second stopping position is smaller than that between the first stopping position and the third stopping position and that between the second stopping position and the third stopping position, thereby paper sheets transported from the first transport path can be diverted at high speed.

Further the paper sheet diverter of the invention includes: a diversion member which is rotatably provided at a junction portion of transport paths in at least three directions for transporting paper sheets; a driving unit for rotationally moving the diversion member; and a control unit for controlling the driving unit to make the diversion member rotationally move to at least four stopping positions including two stopping positions for switching two transport passages for transporting paper sheets from the first transport path to two other transport paths and two positions for switching two transport passages for transporting paper sheets from the second transport path to two other transport paths, and the rotation time of the diversion member between the two stopping positions with respect to the first transport path and that between the two stopping positions with respect to the second transport path are shorter than that between either of the stopping positions with respect to the first transport path and either of the stopping positions with respect to the second transport path.

The diversion member is rotationally moved to at least four stopping positions including the two stopping positions for switching the two transport passages for transporting paper sheets from the first transport path to two other transport paths and the two stopping positions for switching the two transport passages for transporting paper sheets from the second transport path to the two other transport paths, thereby paper sheets can be diverted in multiple directions by one paper sheet diverter. Further, the rotation time of the diversion member between the two stopping positions with respect to the first transport path and that between the two stopping positions with respect to the second transport path are shorter than that between either of the stopping positions with respect to the first transport path and either of the stopping positions with respect to the second transport path, paper sheets transported from the first transport path or the second transport path can be diverted at high speed and the number of paper sheet diverters can be reduced compared with the case of two-directional diverters fulfilling such a diversion function.

Further, with the paper sheet diverter of the invention, the rotation angle of the diversion member between the two stopping positions with respect to the first transport path and that between the two stopping positions with respect to the second transport path are smaller than that between either of the stopping positions with respect to the first transport path and either of the stopping positions with respect to the second transport path.

The rotation angle of the diversion member between two stopping positions with respect to the first transport path and that between two stopping positions with respect to the second transport path are smaller than that between either of the stopping positions with respect to the first transport path and either of the stopping positions with respect to the second transport path, thereby paper sheets transported from the first transport path or the second transport path can be diverted at high speed.

A paper sheet diverter according to another aspect of the invention includes: a diversion member which is rotatably provided at a junction portion of transport paths in at least three directions for transporting paper sheets; a driving unit for rotationally moving the diversion member; and a control unit for controlling the driving unit to make the diversion member rotationally move and performing diversion control for switching two transport passages formed by the one transport path and two other transport paths and direction control for switching transport paths to be subject to the diversion control, and the rotation time of the diversion member in the diversion control is shorter than that in the direction control.

The diversion control for rotationally moving the diversion member and for switching two transport passages formed by one transport path and two other transport paths and the direction control for switching the transport paths to be subject to the diversion control are performed, thereby paper sheets can be diverted in multiple directions by one paper sheet diverter. Further, since the rotation time of the diversion member in the diversion control is shorter than that in the direction control, paper sheets can be diverted at high speed by the diversion control and the number of paper sheet diverters can be reduced compared with the case of two-directional diverters fulfilling such a diversion function.

With a paper sheet diverter according to an additional aspect of the invention, the rotation angle of the diversion member in the diversion control is smaller than that in the direction control.

The rotation angle of the diversion member in the diversion control is smaller than that in the direction control, thereby paper sheets can be diverted at high speed.

With a paper sheet diverter according to a further aspect of the invention, the diversion member has an external shape one end of which the diversion member tapers off, the other end thereof is wide, and transport faces for transporting paper sheets are provided at both side faces from one end to the other end of the diversion member.

The diversion member has an external shape one end of which the diversion member tapers off, the other end thereof is wide, and transport faces for transporting paper sheets are provided at both side faces from the one end to the other end of the diversion member, thereby switching the transport passages with respect to a transport path, toward which the one end of the diversion member turns, can be performed at a relatively small angle and paper sheets can be diverted at high speed.

With a paper sheet diverter according to another feature of the invention, the driving unit includes a driving portion for rotationally moving the diversion member and a positioning unit for applying rotational resistance at a stopping position of the diversion member.

The diversion member can be arbitrarily rotationally moved by the driving portion in accordance with the direction control and diversion control and the positioning unit applies rotational resistance at the stopping position of the diversion member which is switched by the diversion control, thereby the diversion member can be prevented from running over the stopping position and the stopping position of the diversion member can be stabilized in high-speed diversion control.

With a paper sheet diverter according to another aspect of the invention, the driving unit includes a diversion control driving unit for rotationally moving the diversion member in accordance with the diversion control and a direction control driving unit for rotationally moving the diversion member in accordance with the direction control.

The driving unit includes the diversion control driving unit for rotationally moving the diversion member in accordance with the diversion control and the direction control driving unit for rotationally moving the diversion member in accordance with the direction control, thereby the direction control and diversion control can be suitably performed.

With a paper sheet diverter according to an additional feature of the invention, the diversion control driving unit regulates the rotational range of the diversion member between two positions for switching two transport passages with respect to one transport path to make the diversion member rotationally move between the two positions in accordance with the diversion control.

Since the diversion control driving unit regulates the rotational range of the diversion member between the two positions for switching two transport passages with respect to the one transport path to make the diversion member rotationally move between the two positions in accordance with the diversion control, high-speed switching can be performed and the stopping position of the diversion member can be fixed.

With a paper sheet diverter according to an additional aspect of the invention, the direction control driving unit includes a rotation body rotationally moving together with the diversion member via the diversion control driving unit and a driving portion for rotationally moving the rotation body.

The direction control driving unit includes the rotation body rotationally moving together with the diversion member via the diversion control driving unit, and the rotation body is rotationally moved to facilitate the direction control of the diversion member.

With a paper sheet diverter according to a further feature of the invention, the direction control driving unit includes a driving portion for rotationally moving the diversion member to switch the transport paths to be subject to the diversion control via the diversion control driving unit.

The direction control driving unit locks, by a locking unit, the diversion member at the respective stopping positions of the diversion member which has switched the transport paths to be subject to the diversion control by rotationally moving the diversion member via the diversion control driving unit, therefore, the structure can be simplified.

With a paper sheet diverter according to a further aspect of the invention, the direction control driving unit includes: a locking unit for locking the diversion member which has switched transport paths to be subject to the diversion control at the respective stopping positions; a switch body for rotationally moving the diversion member to switch the transport paths to be subject to the diversion control via the diversion control driving unit; and a driving portion for driving the switch body.

The direction control driving unit locks, by driving of the switch body, the diversion member at the respective stopping positions of the diversion member which has switched the transport paths to be subject to the diversion control by rotationally moving the diversion member via the diversion control driving unit, even if the driving position of the switch body is lower in accuracy, the respective stopping positions of the diversion member are higher in accuracy, and an inexpensive motor can be used for the driving portion for driving the switch body.

With a paper sheet diverter according to another feature of the invention, the direction control driving unit includes: a rotatable cam; a contact which moves along a cam face of the cam and rotationally moves the diversion member via the diversion control driving unit; and a driving portion for rotationally moving the cam.

The direction control driving unit makes, by rotation of the cam, the contact moving along the cam face of the cam and the diversion member rotationally move via the diversion control driving unit, thereby the stopping position of the diversion member can be made accurate.

Further, in an additional aspect of the invention, the paper sheet diverter includes a plurality of sets of diversion members and rotation bodies rotationally moving together with the diversion members; a drive transmission body for performing drive transmission so that the plurality of rotation bodies integrally rotationally move; and a driving portion for rotationally moving the plurality of rotation bodies integrally via the drive transmission body.

In the case where a plurality of diversion members are used, the plurality of rotation bodies are integrally rotationally moved via the drive transmission body by one driving portion, thereby the diversion control and direction control of the plurality of diversion members can be collectively performed, and the constitution can be simplified and downsized.

Further, in an additional aspect of the invention the paper sheet diverter includes a plurality of sets of diversion members and diversion control driving units are provided, the direction control driving unit includes: a plurality of rotation bodies each rotationally moving together with the respective diversion members via the respective diversion control driving units; a drive transmission body for performing drive transmission so that the plurality of rotation bodies integrally rotationally move; and a driving portion for rotationally moving the plurality of rotation bodies integrally via the drive transmission body.

The direction control driving unit includes the rotation bodies rotationally moving together with the diversion members via the diversion control driving units and rotationally moves the rotation bodies, thereby the direction control of the diversion members can be easily performed. Further, in the case where a plurality of sets of diversion members and diversion control driving units are used, the plurality of rotation bodies are integrally rotationally moved via the drive transmission body by one driving portion, thereby the direction control of the plurality of diversion members can be collectively performed, and the constitution can be simplified and downsized.

Further, in another asepct of the invention, the paper sheet diverter includes a plurality of sets of diversion members and diversion control driving units, the direction control driving unit includes: locking units for locking the diversion member which has switched the transport paths to be subject to the diversion control at the respective stopping positions; a switch body for rotationally moving the respective diversion members via the respective diversion control driving units to switch the transport paths to be subject to the diversion control; and a driving portion for rotationally moving the switch body.

In the case where a plurality of sets of diversion members and diversion control driving units are used, the plurality of diversion members are rotationally moved via the plurality of diversion control driving units by rotation of one switch body in the direction control driving unit, thereby the constitution can be simplified and downsized. Further, the respective diversion members which have switched the transport paths to be subject to the diversion control are locked at the respective stopping positions by the respective locking units, even if a rotation position of the switch body is lower inaccuracy, the respective stopping positions of the respective diversion members are higher in accuracy, thereby an inexpensive motor can be used for the driving portion for rotationally moving the switch body.

Further, in an additional aspect of the invention the paper sheet diverter includes a plurality of sets of diversion members and diversion control driving units, the direction control driving unit includes: a rotatable cam; a plurality of contacts which move along a cam face of the cam and rotationally move the respective diversion members via the respective diversion control driving units; and a driving portion for rotationally moving the cam.

In the case where a plurality of sets of diversion members and diversion control driving units are used, the plurality of diversion members are rotationally moved via the plurality of contacts each moving the cam face of the cam and the plurality of diversion control driving units by rotation of one cam in the direction control driving unit, thereby the stopping positions of the plurality of diversion members can be made accurate, and the constitution can be simplified and downsized.

A paper sheet processing apparatus according to a further aspect of the invention includes a transport unit for transporting paper sheets between transport paths in at least three directions and the paper sheet diverters of the present invention provided in the transport unit.

The paper sheet diverter according to the present invention is provided in the transport unit for transporting paper sheets between the transport paths in at least three directions, the number of paper sheet diverters can be reduced, and a transport path can be simplified and downsized. A paper sheet processing apparatus according to an aspect of the invention includes a transport unit for transporting paper sheets between transport paths in at least three directions and the paper sheet diverters provided in the transport unit. The paper sheet diverter of the invention is provided in the transport unit for transporting paper sheets between the transport paths in at least three directions, the number of paper sheet diverters can be reduced, and a transport path can be simplified and downsized. A paper sheet processing apparatus according to an additional aspect of the invention includes a transport unit for transporting paper sheets between transport paths in at least three directions and the paper sheet diverters provided in the transport unit. The paper sheet diverter of the invention is provided in the transport unit for transporting paper sheets between the transport paths in at least three directions, the number of paper sheet diverters can be reduced, and a transport path can be simplified and downsized.

A paper sheet diverting method according to an additional aspect of the invention is a paper sheet diverting method for rotationally moving a diversion member provided at a junction portion of transport paths in at least three directions for transporting paper sheets to switch transport passages of paper sheets, the diversion member is rotationally moved by diversion control to divert paper sheets, which are continuously transported from the one transport path, to the two other transport paths, the diversion member is rotationally moved by direction control to switch the transport paths to be subject to the diversion control, and a rotation time of the diversion member in the diversion control is shorter than that in the direction control.

The diversion member is rotationally moved by diversion control to divert paper sheets, which are continuously transported from one of the transport paths, to the two other transport paths, and the diversion member is rotationally moved by direction control to switch transport paths to be subject to the diversion control, thereby paper sheets can be diverted in multiple directions by one paper sheet diverter. Further, the rotation time of the diversion member in the diversion control is shorter than that in the direction control, paper sheets can be diverted at high speed and the number of paper sheet diverters can be reduced compared with the case of two-directional diverters fulfilling such a diversion function.

A paper sheet diverting method according to an additional feature of the invention is a paper sheet diverting method for rotationally moving a diversion member provided at a junction portion of transport paths in at least three directions for transporting paper sheets to switch transport passages of paper sheets, the diversion member is rotationally moved by diversion control to divert paper sheets, which are continuously transported from the one transport path, to the two other transport paths, the diversion member is rotationally moved by direction control to switch the transport paths to be subject to the diversion control, and the rotation angle of the diversion member in the diversion control is smaller than that in the direction control.

The diversion member is rotationally moved by diversion control to divert paper sheets, which are continuously transported from one of the transport paths, to the two other transport paths, and the diversion member is rotationally moved by direction control to switch transport paths to be subject to the diversion control, thereby paper sheets can be diverted in multiple directions by one paper sheet diverter. Further, the rotation angle of the diversion member in the diversion control is smaller than that in the direction control, thereby the rotation time of the diversion member in the diversion control is easily shortened and paper sheets can be diverted at high speed.

EFFECT OF THE INVENTION

According to the present invention, paper sheets can be diverted in multiple directions by one paper sheet diverter, high-speed diversion of paper sheets can be performed, and the number of paper sheet diverters can be reduced compared with the case of two-directional diverters fulfilling such a diversion function.

REFERENCE NUMERALS

Figure 1:
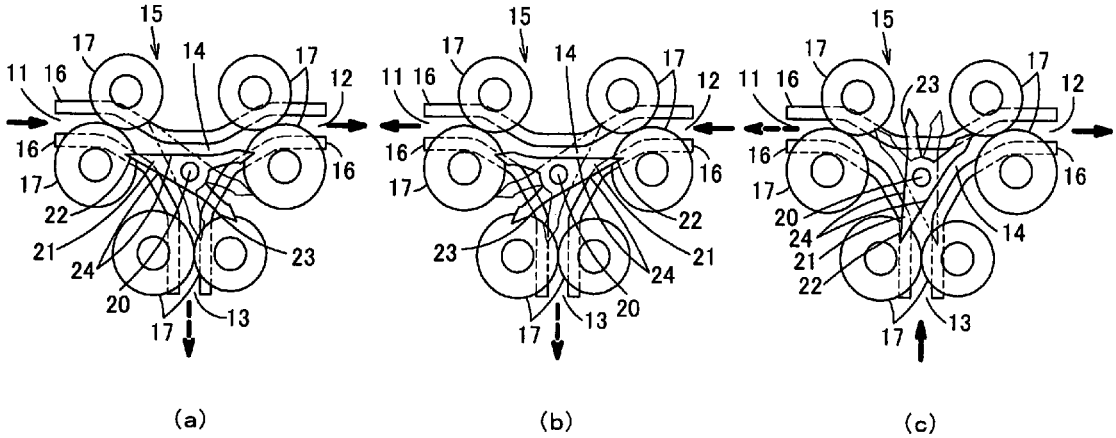
FIG. 1 shows an embodiment of the present invention, and FIGS. 1(*a*), (*b*) and (*c*) are side views each showing a paper sheet diverter subject to direction control.

11-13 Transport path
14 Junction portion
15 Diverter as paper sheet diverter
21 Diversion member
24 Transport face
32 Driving unit
33 Stepping motor as driving portion
38 Positioning unit
44 Diversion control driving unit

45 Direction control driving unit
49 Stepping motor as driving portion
51 Synchronous pulley as rotation body
52 Synchronous belt as drive transmission body
58 Cam follower as contact
60 Cam as switch body
66 Motor as driving portion
69 Locking unit
81 Cam
82 Cam face
87 Cam
88 Cam face
93 Solenoid as driving portion
209 Transport unit
309 Transport unit

BEST MODE FOR CARRYING OUT THE INVENTION

Hereinafter, embodiments of the present invention will be described with reference to the drawings.

FIGS. 1(*a*), (*b*) and (*c*) are side views showing a paper sheet diverter subject to direction control. At a junction portion 14 at which three transport paths including a first transport path 11, second transport path 12 and third transport path 13 intersect, a diverter 15 is disposed as a paper sheet diverter for switching the transport direction of paper sheets, for example, banknotes transported in these transport paths 11 to 13.

A pair of guides 16, which face both faces of a banknote and guide the banknote, are disposed at the respective transport paths 11 to 13, and a plurality of sets of transport rollers 17 for holding and transporting the banknote in the transport paths 11 to 13 are disposed at a plurality of places including ends facing the junction portion 14.

The diverter 15 includes a diversion member 21 rotatably disposed by a rotary axis 20 which is arranged in a path width direction so as to pass through the center of the junction portion 14. The diversion members 21 are arranged at a plurality of places in an axial direction of the rotary axis 20 (see FIG. 4), the guides 16 and the transport rollers 17 are also dividedly arranged at a plurality of places in the path width direction so as not to interfere with each other, and the diversion member 21 can be rotationally moved without interfering with the guides 16 and transport rollers 17.

The diversion member 21 is substantially triangular, and one end of which the acute tip 22 is formed to taper off, the other end of which the wide rear end 23 is formed, and transport faces 24 for transporting banknotes in both side faces extending from the one end to the other end.

The diversion member 21 can be rotationally moved to six stopping positions at maximum including, as shown in FIG. 1(*a*), two stopping positions (indicated by the solid lines and double dotted lines) for turning the acute tip 22 of the diversion member 21 toward the first transport path 11 to switch two transport passages for transporting banknotes from the first transport path 11 to two other transport paths 12 and 13, as shown in FIG. 1(*b*), two stopping positions (indicated by the solid lines and double dotted lines) for turning the acute tip 22 of the diversion member 21 toward the second transport path 12 to switch two transport passages for transporting banknotes from the second transport path 12 to the two other transport paths 11 and 13, and as shown in FIG. 1(*c*), two stopping positions (indicated by the solid lines and double dotted lines) for turning the acute tip 22 of the diversion member 21 toward the third transport path 13 to switch two transport passages for transporting banknotes from the third transport path 13 to the two other transport paths 11 and 12.

At this time, the rotation angle of the diversion member 21 between the two stopping positions for switching the two transport passages for transporting banknotes from the first transport path 11 to the two other transport paths 12 and 13 with the acute tip 22 of the diversion member 21 turning toward the first transport path 11 as shown in FIG. 1(*a*), the rotation angle of the diversion member 21 between the two stopping positions for switching the two transport passages for transporting banknotes from the second transport path 12 to the two other transport paths 11 and 13 with the acute tip 22 of the diversion member 21 turning toward the second transport path 12 as shown in FIG. 1(*b*) and the rotation angle of the diversion member 21 between the two stopping positions for switching the two transport passages for transporting banknotes from the third transport path 13 to the two other transport paths 11 and 12 with the acute tip 22 of the diversion member 21 turning toward the third transport path 13 as shown in FIG. 1(*c*) are smaller than the rotation angle of the diversion member 21 in largely switching the direction to which the acute tip 22 of the diversion member 21 is turned between the first transport path 11, second transport path 12 and third transport path 13, and the rotation time of the diversion member 21 each between the two stopping positions is shorter than that in largely switching the direction of the acute tip 22 of the diversion member 21.

Switching two transport passages for transporting banknotes from one transport path (for example, first transport path 11) to the two other transport paths (for example, second and third transport paths 12 and 13) is called "diversion control," switching the transport paths (transport paths 11, 12 and 13) to be subject to the diversion control is called "direction control," and the diversion control and direction control are controlled by a control unit (not shown). Accordingly, the rotation angle of the diversion member 21 in the diversion control is smaller than that in the direction control, and the rotation time of the diversion member 21 in the diversion control is shorter than that in the direction control. Further, the rotation time of the diversion member 21 in the diversion control can be made even shorter than that in the direction control by making the rotation speed of the diversion member 21 in the diversion control higher than that in the direction control.

If banknotes continuously transported from the first transport path 11 are diverted to the two other paths 12 and 13, as shown in FIG. 1(*a*), by switching the stopping positions (indicated by the solid lines and double dotted lines) of the diversion member 21 by the diversion control in a state where the acute tip 22 of the diversion member 21 is rotationally moved by the direction control to a position facing the first transport path 11 in the direction from which the banknotes are transported, the banknotes continuously transported from the first transport path 11 can be diverted to the two other transport paths 12 and 13 at high speed.

Additionally, if banknotes continuously transported from the second transport path 12 or third transport path 13 are diverted at high speed, by rotationally moving the diversion member 21 by the direction control to a position where the acute tip 22 turns toward the second transport path 12 or third transport path 13 as shown in FIG. 1(*b*) or (*c*), the banknotes can be similarly diverted at high speed by the diversion control.

The diverter 15 thus can singly divert banknotes in multiple directions by the diversion control for rotationally moving the diversion member 21 to switch the two transport passages formed by one transport path and the two other transport paths and by the direction control for switching the transport paths to be subject to the diversion control. Further, the rotation angle of the diversion member 21 in the diversion control is smaller than that in the direction control and the rotation time required for the rotation in the diversion control is shorter than that in the direction control, thereby banknotes can be diverted at high speed and the number of diverters can be reduced compared with the case of two-directional diverters fulfilling such a diversion function.

Further, the diversion member 21 has an external shape one end of which the diversion member tapers off, the other end thereof is wide, and the diversion member 21 has the transport faces 24 for transporting banknotes at its both side faces extending from the one end to the other end, thereby switching the transport passages with respect to the transport path, toward which the one end of the diversion member 21 turns, can be performed at a relatively small angle and banknotes can be diverted at high speed.

Figure 2:
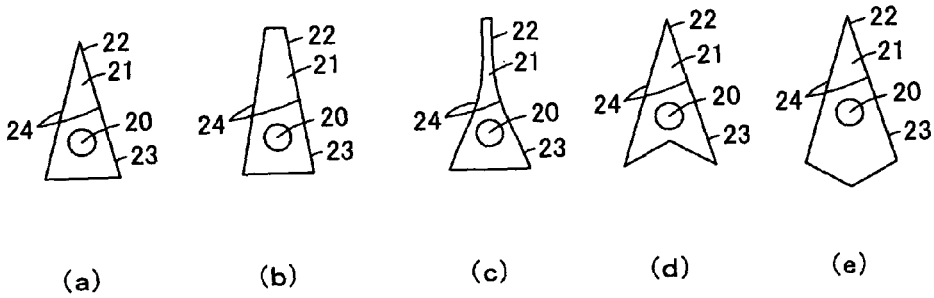
FIGS. 2(*a*), (*b*), (*c*), (*d*) and (*e*) are side views each showing a modification of a diversion member of the above-described paper sheet diverter.

Also, as long as the diversion member 21 has an external shape one end of which the diversion member tapers off, the other end thereof is wide, as shown in the respective examples in FIG. 2, the one end may be angular (see FIGS. 2(*a*), (*d*) and (*e*)) or non-angular (see FIGS. 2(*b*) and (*c*)) and the transport face 24 may be flat (see FIGS. 2(*a*), (*b*), (*d*) and (*e*)) or curvedly recessed along the path (see FIG. 2(*c*)). Additionally, a part between the transport faces 24 of both sides at the other end of the diversion member 21 may be notched so as to be recessed (see FIG. 2(*d*)) or, on the contrary, to be projected (see FIG. 2(*e*)). When a part between the transport faces 24 of both ends at the other end of the diversion member 21 is notched, the diversion member 21 can be reduced in weight and rotationally moved at high speed, and the stopping position thereof can be stabilized.

Additionally, in the diverter 15 shown in FIG. 1, although six stopping positions of the diversion member 21 are set at maximum in the case where high-speed diversion is allowed with respect to all of the transport paths 11, 12 and 13 in three directions, the number of stopping positions of the diversion member 21 can be reduced in the case where the high-speed diversion is unnecessary for even one of the transport paths 11, 12 and 13 in the three directions.

Figure 3:
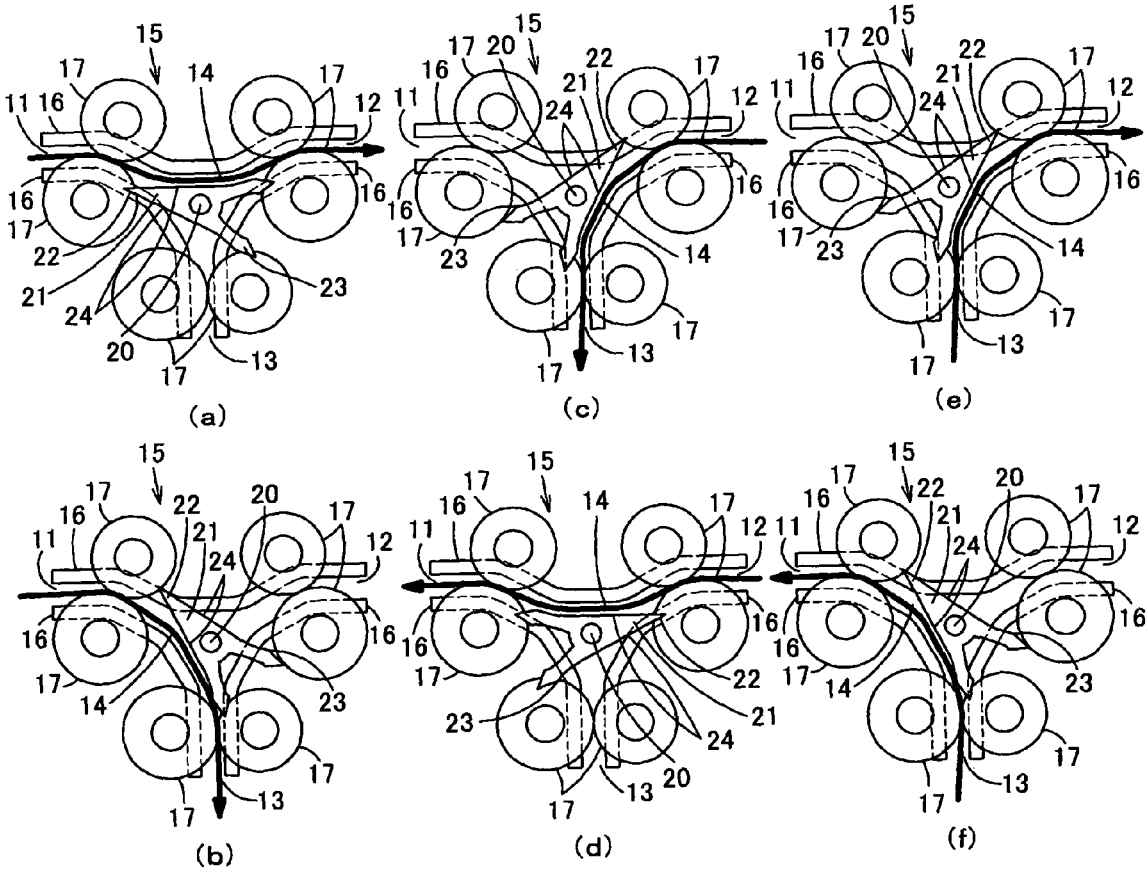
FIGS. 3(*a*), (*b*), (*c*), (*d*), (*e*) and (*f*) are side views each showing the above-described paper sheet diverter in which the direction control is performed.

For example, in the case where although the high-speed diversion is necessary for the first transport path 11 and the second transport path 12 as shown in FIGS. 3(*a*), (*b*) and (*c*), (*d*), banknotes transported from the third transport path 13 are transported to only either the first transport path 11 or the second transport path 12 as shown in FIGS. 3(*e*) and (*f*), the high-speed diversion becomes unnecessary for the third transport path 13, the acute tip 22 of the diversion member 21 is not required to be turned toward the third transport path 13, the stopping positions of the diversion member 21 are set to be the stopping positions shown in FIGS. 3(*b*) or (C), and the number of stopping positions of the diversion member 21 can be reduced to four positions, the position shown in FIG. 3(*a*), the position shown in FIG. 3(*b*) or (*f*), the position shown in FIG. 3(*c*) or (*e*) and the position shown in FIG. 3(*d*).

Further, in the case where the high-speed diversion is also unnecessary for the second transport path 12, the stopping position shown in FIG. 3(*d*) can be substituted by the stopping position shown in FIG. 3(*a*), and the number of stopping positions of the diversion member 21 can be reduced to three positions including the position shown in FIG. 3(*a*), the position shown in FIG. 3(*b*) or (*f*), and the position shown in FIG. 3(*c*) or (*e*). That is, in this case, the stopping positions of the diversion member 21 are three positions, a first stopping position connecting the first transport path 11 and the second transport path 12 to form a first transport passage, a second stopping position connecting the first transport path 11 and the third transport path 13 to form a second transport passage and a third stopping position connecting the transport paths 12 and 13 other than the first transport path 11 to form a third transport passage.

As described above, in the case where the high-speed diversion is unnecessary for even one of the transport paths 11, 12 and 13 in three directions, the number of stopping positions of the diversion member 21 can be reduced to make control easy.

Figure 4:
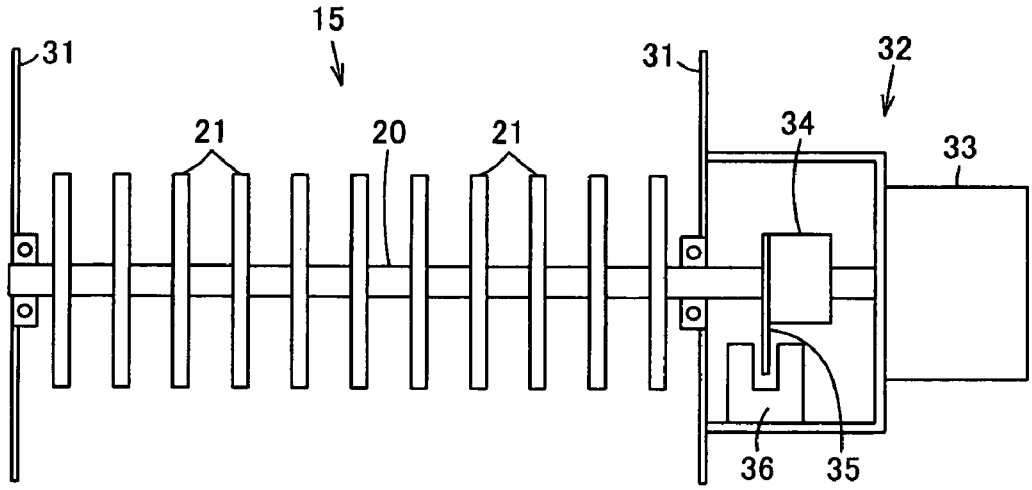
FIG. 4 is a cross sectional view showing the first driving method of the paper sheet diverter.

Next, FIG. 4 shows the first driving method of a diverter 15.

Both ends of the rotary axis 20, on which the plurality of diversion members 21 are rotatably attached to side plates 31 of both sides of the transport paths 11 to 13, and a driving unit 32 for rotationally moving the diversion members 21 is disposed at one end of the rotary axis 20. The driving unit 32 has a stepping motor 33 as a driving portion which can be positionally controlled, and a driving axis of the stepping motor 33 is connected to the rotary axis 20 via a coupling 34.

In order to detect the rotation reference position of the diversion member 21, a light shielding plate 35 is attached to the rotary axis 20 side, a photointerrupter 36 is attached to the side plate 31 side, and a rotation reference position of the diversion member 21 is detected at a position where the photointerrupter 36 is switched from light transmission to light shielding and from light shielding to light transmission by the light shielding plate 35 rotationally moving integrally with the diversion member 21.

The control unit controls the stepping motor 33 based on the rotation reference position of the diversion member 21 so as to rotationally move and stop the diversion member 21 to a predetermined stopping position in accordance with the diversion control and direction control.

Figure 5:
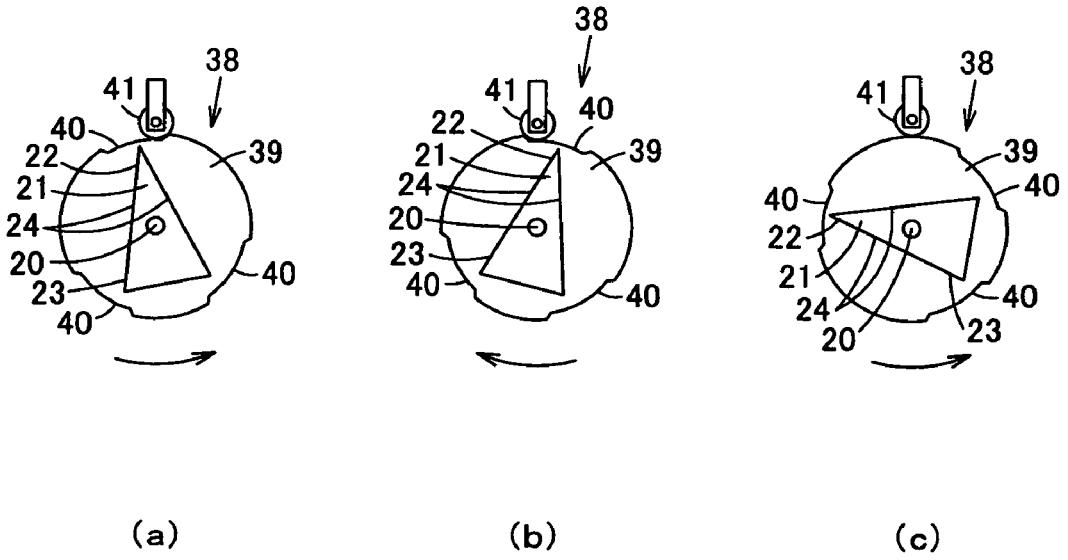
FIGS. 5(*a*), (*b*) and (*c*) are side views each showing operation of a positioning unit used in the above-described first driving method.

As shown in FIG. 5, a positioning unit 38 is used in order to stabilize the stopping position of the diversion member 21. The positioning unit 38 has a rotation member 39 provided on the rotary axis 20, and a recessed portion 40 is formed, for the respective transport paths 11, 12 and 13, at the outer circumference of the rotation member 39 in accordance with a range of rotation angle of the diversion member 21 by the diversion control. A stopper roller 41 as a stopper is pressed against the outer circumference of the rotation member 39 from above by self-weight or a biasing unit. The stopper roller 41 is freely rotatable in a rotating direction of the rotation member 39, and a step portion at an end of the recessed portion of the rotation member 39 comes into contact with a circumferential face of the stopper roller 41 at the respective stopping positions of the diversion member 21 by the diversion control so as to apply rotational resistance.

As shown in FIGS. 5(*a*) and (*b*), the step portion at the end of the recessed portion 40 of the rotation member 39 comes into contact with the circumferential face of the stopper roller 41 at the respective stopping positions of the diversion member 21 which makes a switch by the diversion control so as to apply the rotational resistance, thereby the diversion member 21 can be prevented from running over the respective stopping positions and the stopping position of the diversion member 21 can be stabilized. Additionally, as shown in FIG. 5(*c*), in the direction control of the diversion member 21 for switching the transport paths to be subject to the diversion control, the step portion of the end at the recessed portion 40 of the rotation member 39 pushes up the stopper roller 41 and rotationally moves, that is, rotationally moves riding over the rotational resistance to be engaged with the stopper roller 41.

A property of the stepping motor 33 that the torque is small in high-speed rotation and large in low-speed rotation is here used, and the stopping position of the diversion member 21 can be stabilized by use of the positioning unit 38 by increasing the rotation speed of the diversion member 21 in the diversion control and lowering it in the direction control.

Figure 6:
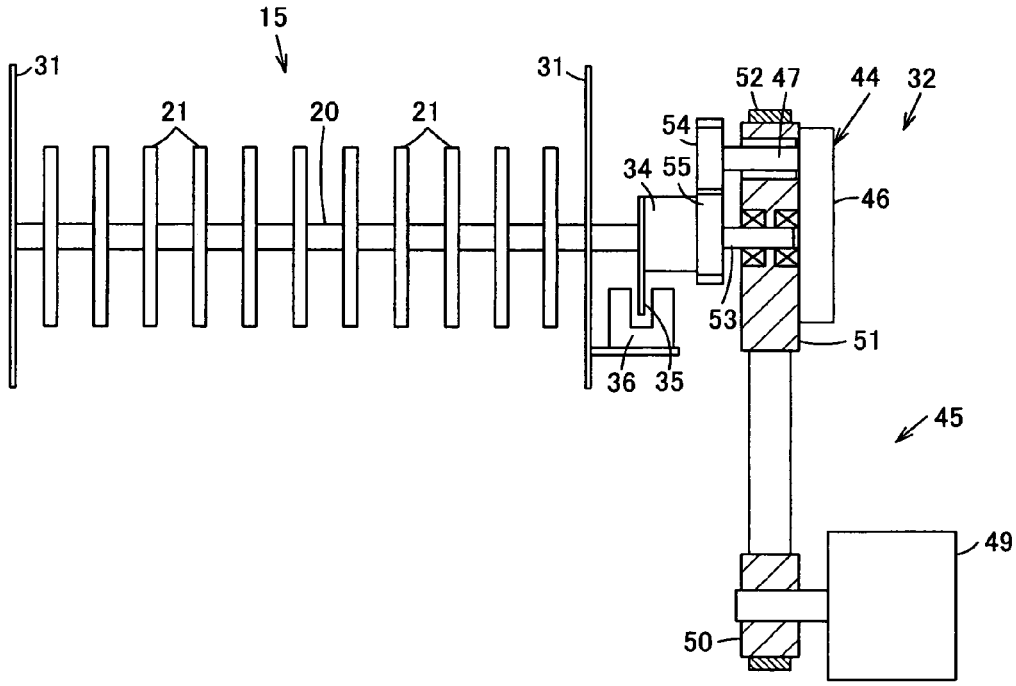
FIG. 6 is a cross sectional view showing the second driving method of the paper sheet diverter.

Next, FIG. 6 shows the second driving method of the diverter 15.

The driving unit 32 includes a diversion control driving unit 44 for rotationally moving the diversion member 21 in accordance with the diversion control and a direction control driving unit 45 for rotationally moving the diversion member 21 in accordance with the direction control.

For the diversion control driving unit 44, the selector 46 is used which regulates the rotational range of the diversion member 21 between two positions for switching two transport passages for transporting banknotes to two transport paths from one transport path to rotationally move the diversion member 21 between the two positions in accordance with the diversion control. The selector 46 is constituted by, for example, a rotary solenoid, a movable magnetic rotary actuator (see, for example, Japanese Patent Publication No. 3748965), a combination of a solenoid and a stopper, or the like, and has a selector axis 47 rotationally moving between two positions.

The direction control driving unit 45 has a stepping motor 49 as a driving portion, a synchronous pulley 50 is attached to a driving axis of the stepping motor 49, and an endless synchronous belt 52 as a drive transmission body is placed around the synchronous pulley 50 and another synchronous pulley 51 as a rotation body. The other synchronous pulley 51 is rotatably pivotally supported by an axis 53 coaxially connected to the rotary axis 20 of the diversion member 21. The selector 46 is attached to a side face of the synchronous pulley 51, a gear 54 is attached to the selector axis 47 of the selector 46, and a gear 55 meshing with the gear 54 is attached to the axis 53.

Also in this case, in order to detect a rotation reference position of the diversion member 21, the light shielding plate 35 and the photointerrupter 36 are provided.

By the direction control of the control unit, the stepping motor 49 is driven based on the rotation reference position of the diversion member 21, the diversion member 21 is rotationally moved to a predetermined stopping position in accordance with the direction control of the diversion member 21, and the transport paths to be subject to the diversion control can be switched. Additionally, by the diversion control of the control unit, the selector 46 is driven, the diversion member 21 is rotationally moved between the two stopping positions in accordance with the diversion control of the diversion member 21, and the two transport passages can be switched.

That is, in the direction control, by driving the stepping motor 49, the synchronous pulley 51 rotationally moves, the selector 46 rotationally moves integrally with the synchronous pulley 51, the rotary axis 20 integrally rotationally moves with the gears 54 and 55 meshing with each other, thereby the diversion member 21 is rotationally moved to the predetermined position in accordance with the direction control, and the transport paths to be subject to the diversion control can be switched.

In the diversion control, in a state where the synchronous pulley 51 is held at a stopping position, by driving the selector 46, the selector axis 47 rotationally moves between the two positions, the rotary axis 20 rotationally moves via the gears 54 and 55, the diversion member 21 is rotationally moved between the two stopping positions, and the two transport passages can be switched.

The diversion control driving unit 44 for rotationally moving the diversion member 21 in accordance with the diversion control and the direction control driving unit 45 for rotationally moving the diversion member 21 in accordance with the direction control are provided, thereby the direction control and diversion control can be respectively suitably controlled.

The diversion control driving unit 44 regulates the rotational range of the divers ion member 21 between two positions for switching two transport passages with respect to one transport path to rotationally move the diversion member 21 between the two positions in accordance with the diversion control, thereby high-speed switching can be performed and the stopping position of the diversion member 21 can be fixed.

Additionally, the direction control driving unit 45 includes the synchronous pulley 51 which rotationally moves together with the diversion member 21 via the diversion control driving unit 44, and the synchronous pulley 51 is rotationally moved, thereby making direction control of the diversion member 21 easy to perform.

Figure 7:
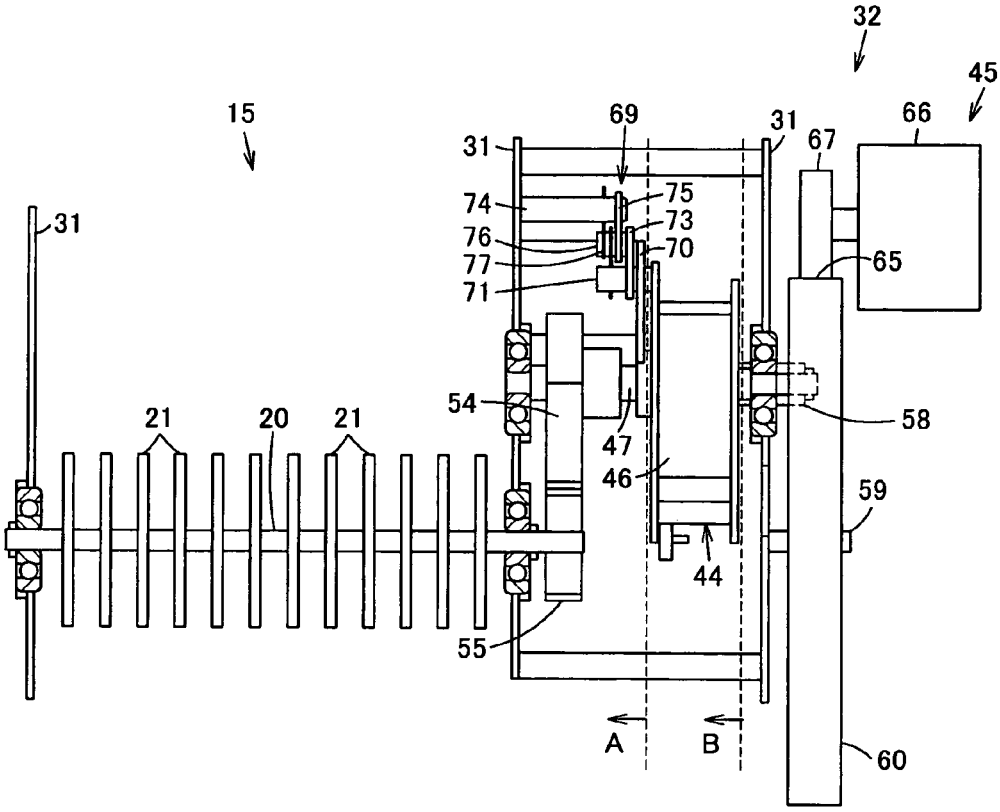
FIG. 7 is a cross sectional view showing the third driving method of the paper sheet diverter.
Figure 8:
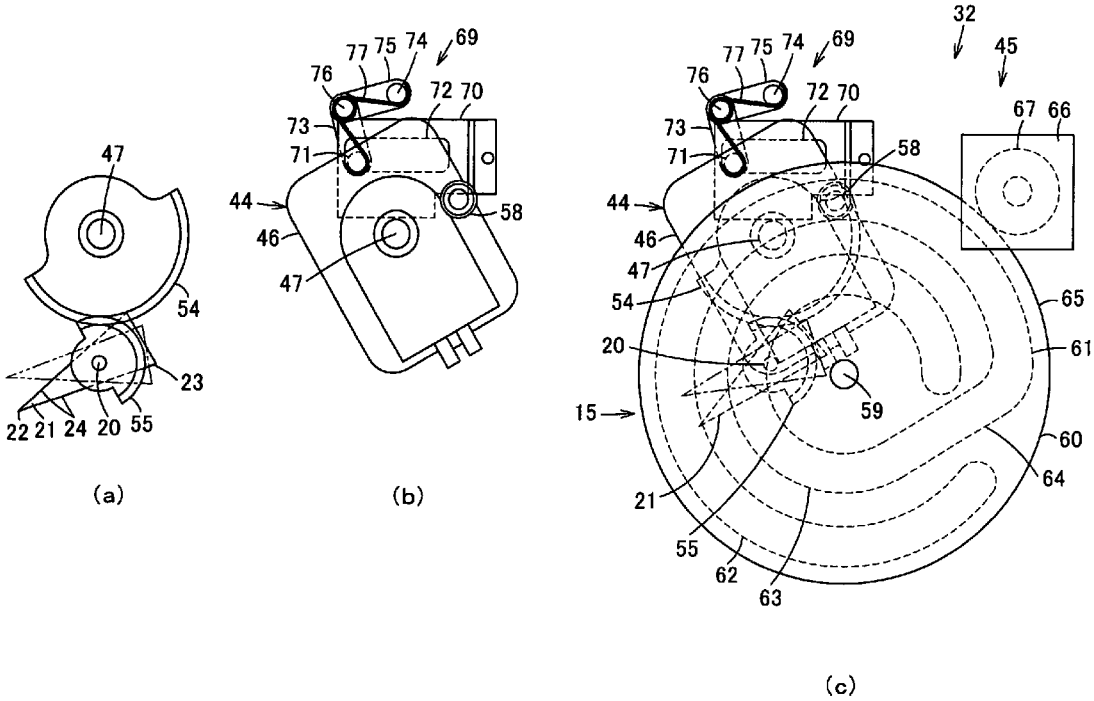
FIG. 8 shows the paper sheet diverter in the above-described third driving method, FIG. 8(*a*) is a view taken in the direction of the arrow A in FIG. 7, FIG. 8(*b*) is a view taken in the direction of the arrow B in FIG. 7, and FIG. 8(*c*) is a side view.
Figure 9:
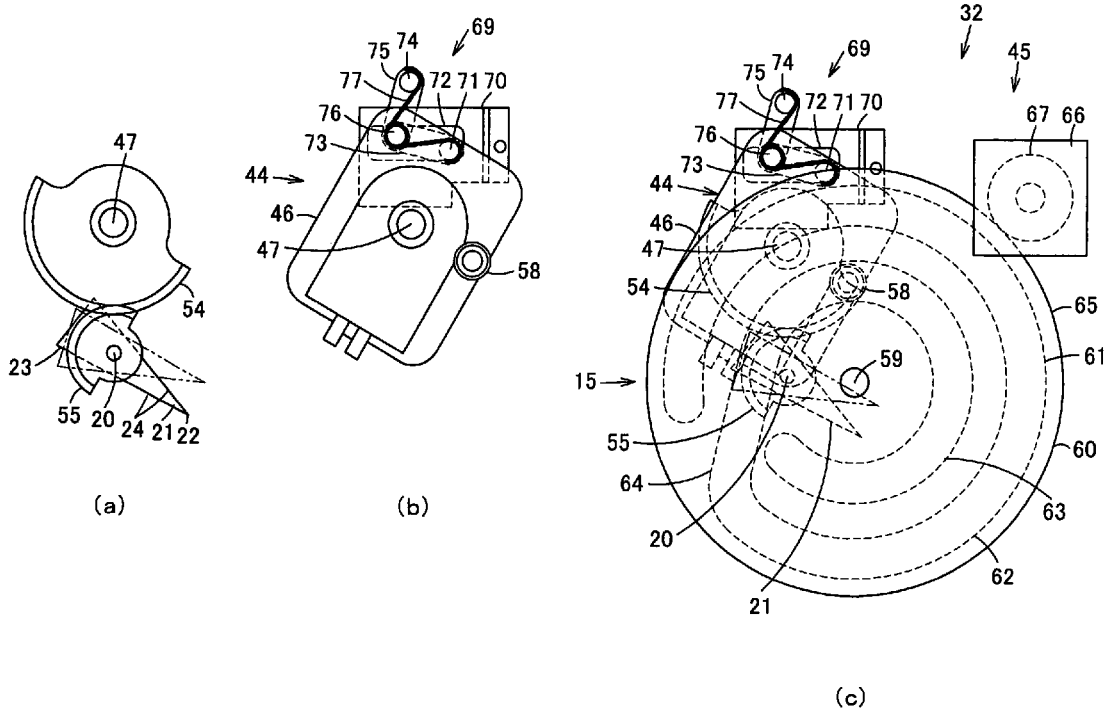
FIG. 9 shows the paper sheet diverter in which the direction control is switched by the above-described third driving method, FIG. 9(*a*) is a view taken in the direction of the arrow A in FIG. 7, FIG. 9(*b*) is a view taken in the direction of the arrow B in FIG. 7, and FIG. 9(*c*) is a side view.

Next, FIGS. 7 to 9 show the third driving method of the diverter 15.

The driving unit 32 includes the diversion control driving unit 44 for rotationally moving the diversion member 21 in accordance with the diversion control and the direction control driving unit 45 for rotationally moving the diversion member 21 in accordance with the direction control.

Similar to the second driving method, for the diversion control driving unit 44, the selector 46 is used which regulates the rotational range of the diversion member 21 between two positions for switching two transport passages for transporting banknotes to two transport paths from one transport path to rotationally move the diversion member 21 between the two positions in accordance with the diversion control. The selector 46 is rotatably supported by the side plate 31 via the selector axis 47, the gear 54 is attached to the selector axis 47, and the gear 55 meshing with the gear 54 is attached to the rotary axis 20. A cam follower 58 as a contact is attached to the side of the selector axis 47 of the selector 46.

The direction control driving unit 45 includes a disk-shaped cam 60 as a switch body rotatable around a cam axis 59. A cam groove 61 with which the cam follower 58 of the selector 46 is engaged, is provided in one face of the cam 60, and the cam groove 61 includes: an outer circumference side cam groove portion 62; an inner circumference side cam groove portion 63; and a connection cam groove portion 64 for connecting the outer circumference side cam groove portion 62 and the inner circumference side cam groove portion 63.

A gear 65 is formed on the outer circumference of the cam 60, and a gear 67 driven by a motor 66 as a driving portion is meshed with the gear 65. The cam 60 is driven forward/reverse by a forward/reverse driving of a motor 66.

Moreover, in order to detect a rotation position of the diversion member 21 or the cam 60, a detecting unit (not shown) using, for example, a light shielding plate and a photointerrupter is used.

As shown in FIG. 8, the acute tip 22 of the diversion member 21 is turned toward one transport path in a state where the cam follower 58 of the selector 46 is engaged with the outer circumference side cam groove portion 62. In this state, the selector 46 is driven by the diversion control, the diversion member 21 is rotationally moved between the two stopping positions, and two transport passages can be switched with respect to one transport path.

Additionally, by rotationally moving the cam 60 counterclockwise shown in FIG. 8, the cam follower 58 is engaged with the inner circumference side cam groove portion 63 from the outer circumference side cam groove portion 62 via the connection cam groove portion 64, as shown in FIG. 9, the selector 46 rotationally moves clockwise around the selector axis 47, the diversion member 21 rotationally moves counterclockwise together with the rotary axis 20 via the gears 54 and 55, and the acute tip 22 of the diversion member 21 is switched to the state where the acute tip 22 turns toward the direction of the other transport paths.

Additionally, by rotationally moving the cam 60 clockwise shown in FIG. 9, the cam follower 58 is engaged with the outer circumference side cam groove portion 62 from the inner circumference side cam groove portion 63 through the connection cam groove portion 64, as shown in FIG. 8, the selector 46 rotationally moves counterclockwise around the selector axis 47, the diversion member 21 rotationally moves clockwise together with the rotary axis 20 via the gears 54 and 55, and the acute tip 22 of the diversion member 21 is switched to the state where the acute tip 22 turns toward the direction of the original one transport path.

There is provided a locking unit 69 for locking the diversion member 21, which has switched the transport paths to be subject to the diversion control, at a correct stopping position. The locking unit 69 has a regulation plate 70 attached to the side plate 31 in the vicinity of the selector 46, and a regulation groove 72, with which a projection 71 projecting from the selector 46 is engaged, is formed in the regulation plate 70. A position where the selector 46 rotationally moves in one direction and the projection 71 comes into contact with one end edge of the regulation groove 72 and a position where the selector 46 rotationally moves in the other direction and the projection 71 comes into contact with the other end edge of the regulation groove 72 are set as a correct stopping position of the diversion member 21 which has switched the transport path to be subject to the diversion control.

The other end of a link 73, of which one end is connected to the projection 71, and the other end of a link 75, of which one end is connected to an axis 74 provided on the side plate 31, are connected to each other via a connection axis 76, the connection axis 76 is equipped with a coil portion of a twisted spring 77, and both ends of the twisted spring 77 are hooked on the projection 71 and the axis 74. A virtual line connecting the selector axis 47 of the selector 46 and the axis 74 is positioned so as to pass through a middle position of the regulation groove 72, the projection 71 located on one end side in relation to the virtual line is biased to one end side by the twisted spring 77, the projection 71 located on the other end side is biased to the other end side by the twisted spring 77, the projection 71 is pressed against each end edge of the regulation groove 72 by bias of the twisted spring 77, and the diversion member 21, which has switched the transport paths to be subject to the diversion control, can be held at the correct stopping position.

Thus, the diversion control driving unit 44 for rotationally moving the diversion member 21 in accordance with the diversion control and the direction control driving unit 45 for rotationally moving the diversion member 21 in accordance with the direction control are provided, thereby the direction control and diversion control can be respectively suitably controlled.

The diversion control driving unit 44 regulates the rotational range of the diversion member 21 between two positions for switching two transport passages with respect to one transport path to rotationally move the diversion member 21 between the two positions in accordance with the diversion control, thereby high-speed switching can be performed and the stopping position of the diversion member 21 can be fixed.

Additionally, the direction control driving unit 45 rotationally moves the diversion member 21 via the cam follower 58 engaged with the cam groove 61 of the cam 60 and the selector 46 by rotation of the cam 60 and locks the diversion member 21 which has switched the transport paths to be subject to the diversion control at the stopping position by the locking unit 69, even if the rotation position of the cam 60 is lower in accuracy, the stopping position of the diversion member 21 is higher in accuracy and the inexpensive motor 66 or the like can be used for the driving portion for rotationally moving the cam 60. Additionally, since the cam itself does not require precision, the cam can be manufactured by inexpensive resin materials which are low in working accuracy and stability of shape to temperature, and constituted at low price.

Additionally, in the third driving method described herein, although transport paths in two directions to be subject to the diversion control are described above, transport paths in three or more directions to be subject to the diversion control can be adopted by changing the shape of the cam groove 61 of the cam 60, for example, making it a triple-cam groove. Here, for example, the recessed portion shown in FIG. 5 may be made small so that the locking unit 69 is stopped at one point.

The disk-shaped cam 60 having the cam groove 61 is described above as a switch body. Since the locking unit 69 is provided, any type of cam such as a lever-shaped cam may be used as long as it is provided with at least a part of the connection cam groove 64.

Figure 10:
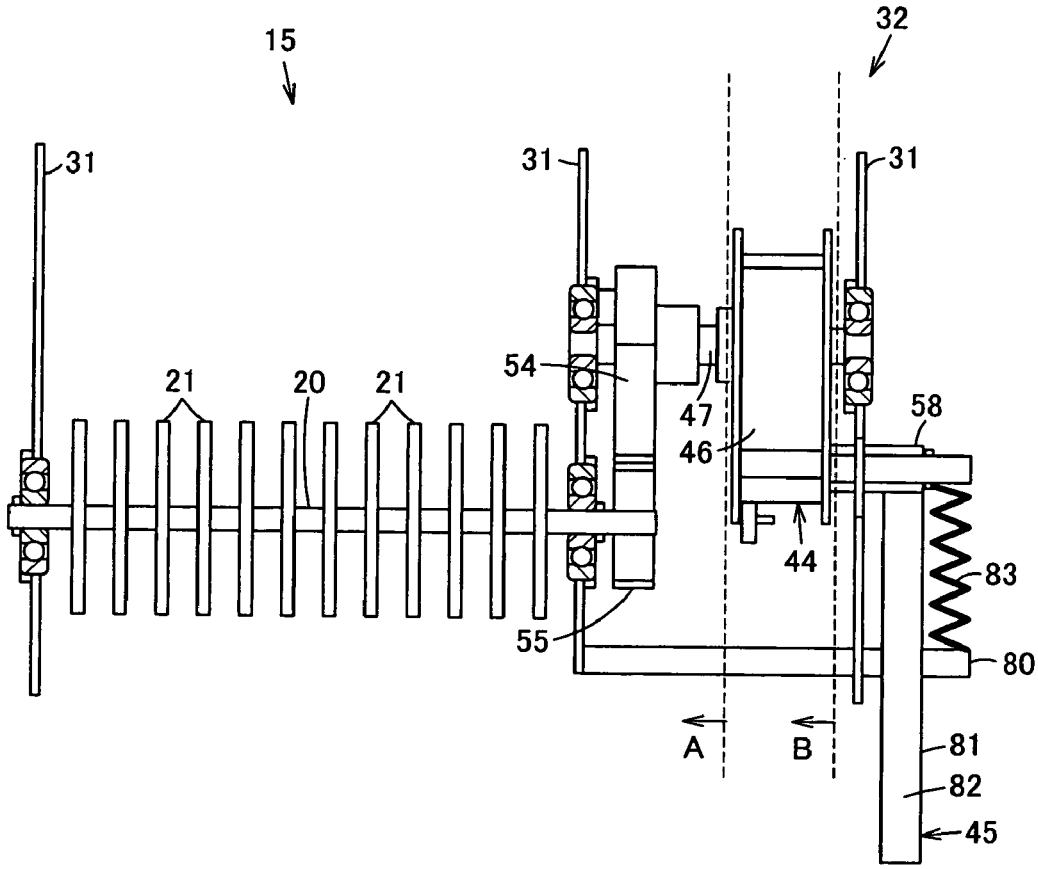
FIG. 10 is a cross sectional view showing the fourth driving method of the paper sheet diverter.
Figure 11:
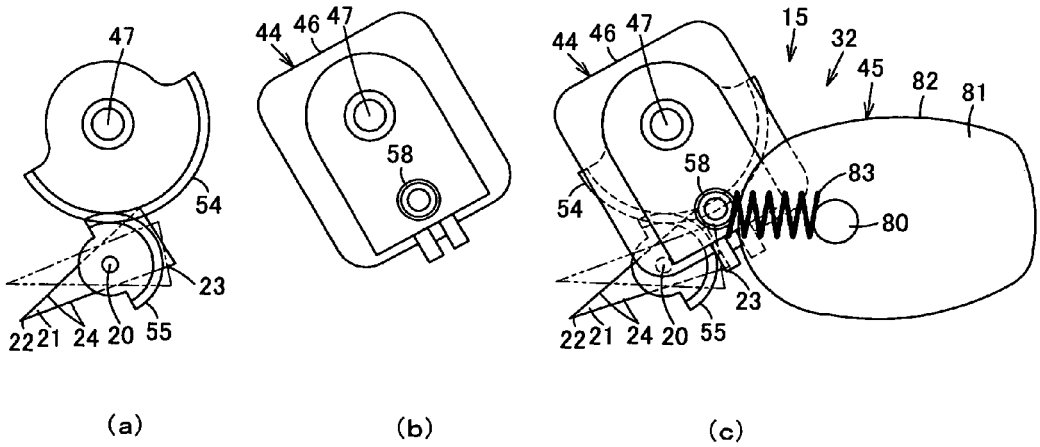
FIG. 11 shows the paper sheet diverter in the above-described fourth driving method, FIG. 11(*a*) is a view taken in the direction of the arrow A in FIG. 10, FIG. 11(*b*) is a view taken in the direction of the arrow B in FIG. 10, and FIG. 11(*c*) is a side view.
Figure 12:
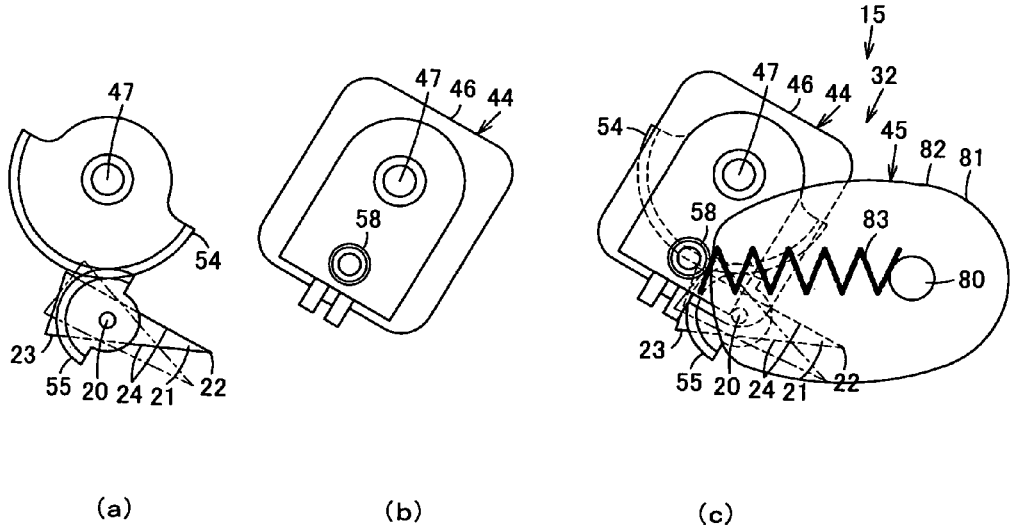
FIG. 12 shows the paper sheet diverter in which the direction control is switched by the above-described fourth driving method, FIG. 12(*a*) is a view taken in the direction of the arrow A in FIG. 7, FIG. 12(*b*) is a view taken in the direction of the arrow B in FIG. 7, and FIG. 12(*c*) is a side view.

Next, FIGS. 10 to 12 show the fourth driving method of the diverter 15.

The driving unit 32 includes the diversion control driving unit 44 for rotationally moving the diversion member 21 in accordance with the diversion control and the direction control driving unit 45 for rotationally moving the diversion member 21 in accordance with the direction control.

Similar to the second driving method, for the diversion control driving unit 44, the selector 46 is used which regulates the rotational range of the diversion member 21 between two positions for switching two transport passages for transporting banknotes to two transport paths from one transport path to rotationally move the diversion member 21 between the two positions in accordance with the diversion control. The selector 46 is rotatably supported by the side plate 31 via the selector axis 47, the gear 54 is attached to the selector axis 47, and the gear 55 meshing with the gear 54 is attached to the rotary axis 20. A cam follower 58 is attached to the side of the selector axis 47 of the selector 46.

The direction control driving unit 45 includes a cam 81 rotatable around a cam axis 80. A cam face 82, with which the cam follower 58 of the selector 46 is engaged, is provided in an outer circumference face of the cam 81, and formed in an eccentric shape having portions near and far from the cam axis 80. A tension spring 83 as a biasing unit is stretched between an axis of the cam follower 58 of the selector 46 and the cam axis 80, and brings the cam follower 58 of the selector 46 into pressure contact with the cam face 82 of the cam 81. A motor (not shown) as a driving portion for rotationally driving the cam 81 is connected to the cam axis 80 via a gear, synchronous belt, etc (not shown).

Moreover, in order to detect a rotation position of the diversion member 21 or the cam 81, a detecting unit (not shown) using, for example, a light shielding plate and a photointerrupter is used.

As shown in FIG. 11, in a state where the cam follower 58 of the selector 46 comes into contact with the position of the cam face 82 near the cam axis 80 of the cam 81, the acute tip 22 of the diversion member 21 turns toward one transport path. In this state, the selector 46 is driven by the diversion control to rotationally move the diversion member 21 between the two stopping positions and two transport passages can be switched with respect to one transport path.

The cam 81 shown in FIG. 11 is rotationally moved, and a part, which comes into contact with the cam follower 58, of the cam face 82 of the cam 81 moves from the portion near the cam axis 80 to the portion far from the cam axis 80, thereby the cam follower 58 is moved so as to move away from the cam axis 80 against the bias of the tension spring 83, and as shown in FIG. 12, the selector 46 rotationally moves clockwise around the selector axis 47, the diversion member 21 rotationally moves counterclockwise together with the rotary axis 20 via the gears 54 and 55, and the acute tip 22 of the diversion member 21 is switched to the state where the acute tip 22 turns toward the direction of the other transport paths.

Additionally, the cam 81 shown in FIG. 12 is rotationally moved, and a part, which comes into contact with the cam follower 58, of the cam face 82 of the cam 81 moves from the portion far from the cam axis 80 to the portion near the cam axis 80, thereby the cam follower 58 is moved so as to approach the cam axis 80 by the bias of the tension spring 83, and as shown in FIG. 11, the selector 46 rotationally moves counterclockwise around the selector axis 47, the diversion member 21 rotationally moves clockwise together with the rotary axis 20 via the gears 54 and 55, and the acute tip 22 of the diversion member 21 is switched to the state where the acute tip 22 turns toward the direction of the original one transport path.

Thus, the diversion control driving unit 44 for rotationally moving the diversion member 21 in accordance with the diversion control and the direction control driving unit 45 for rotationally moving the diversion member 21 in accordance with the direction control are provided, thereby the direction control and diversion control can be respectively suitably controlled.

The diversion control driving unit 44 regulates the rotational range of the diversion member 21 between two positions for switching two transport passages with respect to one transport path to rotationally move the diversion member 21 between the two positions in accordance with the diversion control, thereby high-speed switching can be performed and the stopping position of the diversion member 21 can be fixed.

Also, the direction control driving unit 45 rotationally moves the diversion member 21 via the cam follower 58 moving along the outer circumference of the cam 81 and the selector 46 by rotation of the cam 81, thereby the accuracy of the stopping position of the diversion member 21 can be improved.

Moreover, in the fourth driving method described herein, although transport paths in two directions to be subject to the diversion control are described above, transport paths in three or more directions to be subject to the diversion control can be adopted by changing the shape of the cam face 82 of the cam 81.

Additionally, although the outer circumference face of a plate cam is described as being used as a cam face, another form using the outer circumference and the inner circumference in a groove of a groove cam as a cam face may be used.

Figure 13:
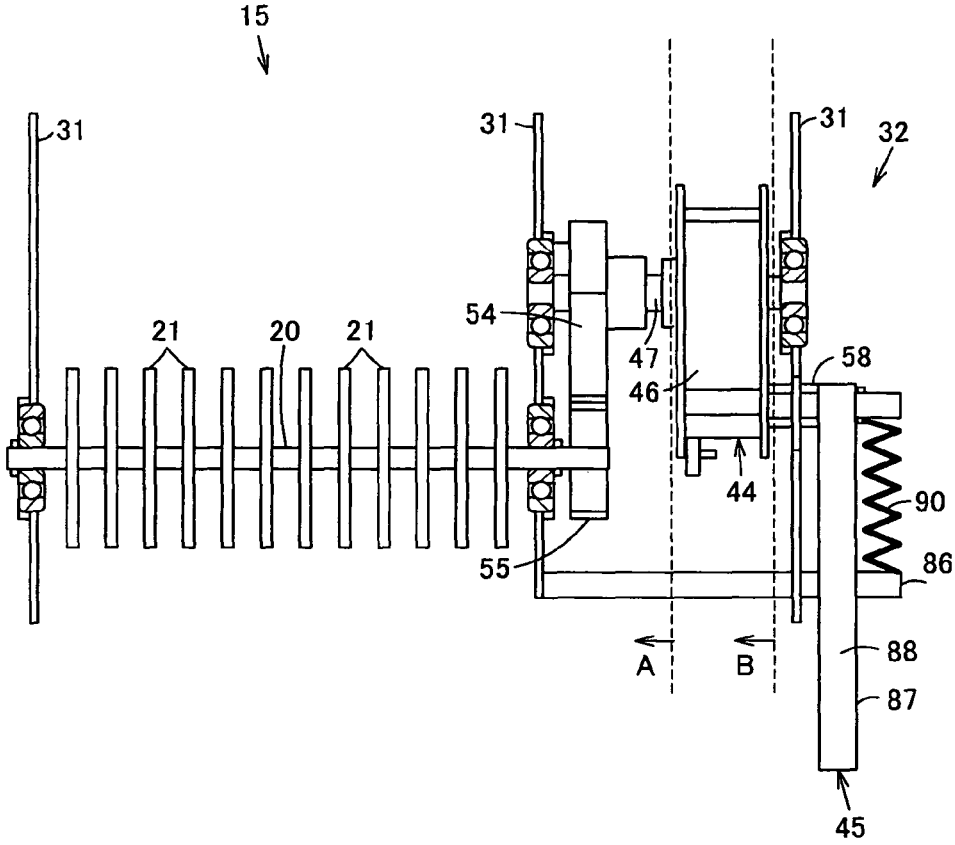
FIG. 13 is a cross sectional view showing the fifth driving method of the above-described paper sheet diverter.
Figure 14:
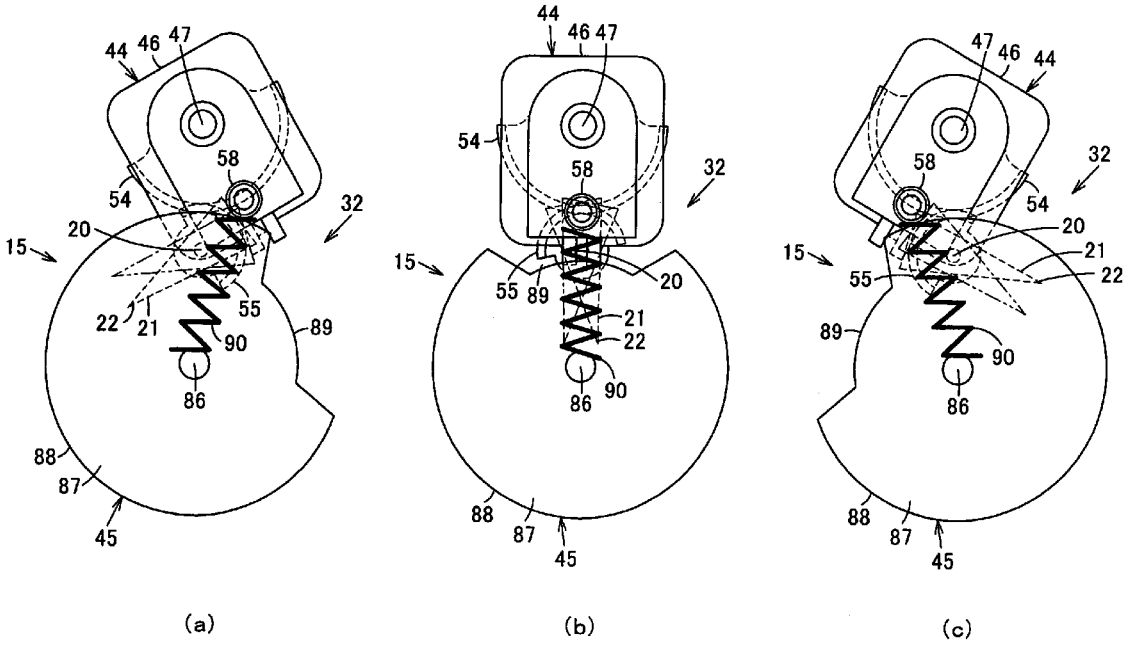
FIGS. 14(*a*), (*b*) and (*c*) are side views each showing the state where the direction control is switched by the paper sheet diverter in the fifth driving method.

Next, FIGS. 13 and 14 show the fifth driving method of the diverter 15.

The driving unit 32 includes the diversion control driving unit 44 for rotationally moving the diversion member 21 in accordance with the diversion control and the direction control driving unit 45 for rotationally moving the diversion member 21 in accordance with the direction control.

For the diversion control driving unit 44, similar to the second driving method, the selector 46 is used which regulates the rotational range of the diversion member 21 between two positions for switching two transport passages for transporting banknotes to two transport paths from one transport path to rotationally move the diversion member 21 between the two positions in accordance with the diversion control. The selector 46 is rotatably supported by the side plate 31 via the selector axis 47, the gear 54 is attached to the selector axis 47, and the gear 55 meshing with the gear 54 is attached to the rotary axis 20. A cam follower 58 is attached to the side of the selector axis 47 of the selector 46.

The direction control driving unit 45 includes a cam 87 rotatable around a cam axis 86. A cam face 88, with which the cam follower 58 of the selector 46 is engaged, is provided in an outer circumference face of the cam 87, and is a disk around the cam axis 86 and has a recessed portion 89 formed at one place. A tension spring 90 as a biasing unit is stretched between an axis of the cam follower 58 of the selector 46 and the cam axis 86. A motor (not shown) as a driving portion for rotationally driving the cam 87 is connected to the cam axis 80. The cam face 88 of the cam 87 is disposed so as to come into contact with the cam follower 58 of the selector 46, but the recessed portion 89 is disposed so as not to come into contact with the cam follower 58.

Moreover, in order to detect the rotation position of the diversion member 21 or the cam 81, a detecting unit (not shown) using, for example, a light shielding plate and a photointerrupter is used.

FIG. 14(*b*) shows the cam 87, in the middle of being rotationally moved in order to switch the transport paths to be subject to the diversion control, the recessed portion 89 of the cam 87 faces the cam follower 58 of the selector 46, and the selector 46 rotationally moves around the selector axis 47 so that the cam follower 58 approaches the cam axis 86 by the bias of the tension spring 90.

In order to switch to the state shown in FIG. 14(*a*), in the case where the cam 87 is rotationally moved clockwise, one side edge of the recessed portion 89 of the cam 87 comes into contact with the cam follower 58, the cam follower 58 is moved rightward against the bias of the tension spring 90, that is, the selector 46 is rotationally moved counterclockwise around the selector axis 47, the cam face 88 located on one side of the recessed portion 89 of the cam 87 comes into contact with the cam follower 58, and the acute tip 22 of the diversion member 21 is switched to the state where the acute tip 22 turns toward the direction of the one transport path.

On the other hand, in order to switch to the state shown in FIG. 14(*c*), in the case where the cam 87 is rotationally moved counterclockwise, the other side edge of the recessed portion 89 of the cam 87 comes into contact with the cam follower 58, the cam follower 58 is moved leftward against the bias of the tension spring 90, that is, the selector 46 is rotationally moved clockwise around the selector axis 47, the cam face 88 located on the other side of the recessed portion 89 of the cam 87 comes into contact with the cam follower 58, and the acute tip 22 of the diversion member 21 is switched to the state where the acute tip 22 turns toward the direction of the other transport paths.

As shown in FIGS. 14(*a*) and (*c*), in a state where the acute tip 22 of the diversion member 21 turns toward the respective transport paths, the selector 46 is driven by the diversion control, the diversion member 21 is rotationally moved between the two stopping positions, and two transport passages can be switched with respect to the respective transport paths.

Thus, the diversion control driving unit 44 for rotationally moving the diversion member 21 in accordance with the diversion control and the direction control driving unit 45 for rotationally moving the diversion member 21 in accordance with the direction control are provided, thereby the direction control and diversion control can be respectively suitably controlled.

The diversion control driving unit 44 regulates the rotational range of the diversion member 21 between two positions for switching two transport passages with respect to one transport path to rotationally move the diversion member 21 between the two positions in accordance with the diversion control, thereby high-speed switching can be performed and the stopping position of the diversion member 21 can be fixed.

Also, the direction control driving unit 45 rotationally moves the diversion member 21 via the cam follower 58 moving along the outer circumference of the cam 87 and the selector 46 by rotation of the cam 87, thereby the accuracy of the stopping position of the diversion member 21 can be improved.

Moreover, in the fifth driving method described herein, although transport paths in two directions to be subject to the diversion control are described above, transport paths in three or more directions to be subject to the diversion control can be adopted by changing the shape of the cam face 82 of the cam 81, for example, making the cam face 88 of the cam 81 into two steps or more.

Additionally, although the outer circumference face of a plate cam is described as being used as a cam face, the outer circumference and the inner circumference in a groove of a groove cam may be used as a cam face.

Figure 15:
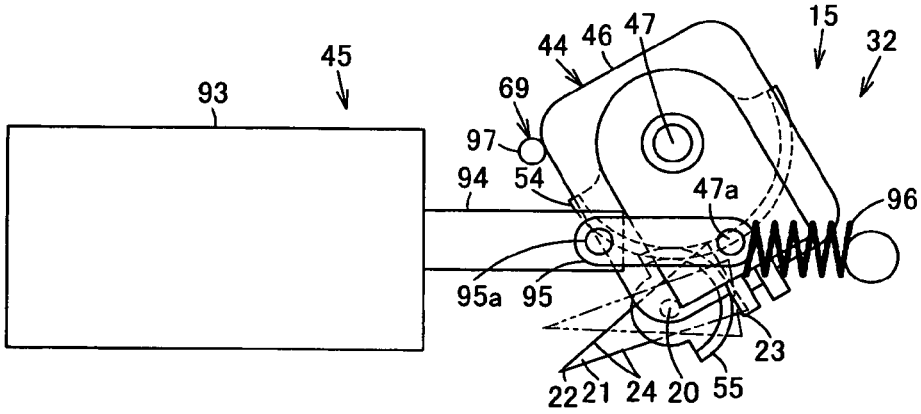
FIGS. 15(*a*) and (*b*) are side views each showing the state where the direction control is switched by the paper sheet diverter in the sixth driving method.
Figure 15:
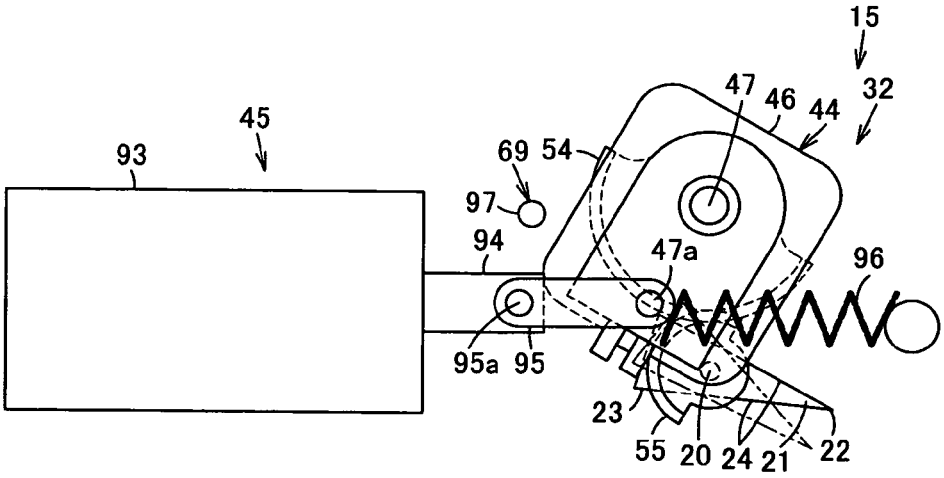

Next, FIG. 15 shows the sixth driving method of the diverter 15.

The driving unit 32 includes the diversion control driving unit 44 for rotationally moving the diversion member 21 in accordance with the diversion control and the direction control driving unit 45 for rotationally moving the diversion member 21 in accordance with the direction control.

For the diversion control driving unit 44, similar to the second driving method, the selector 46 is used which regulates the rotational range of the diversion member 21 between two positions for switching two transport passages for transporting banknotes to two transport paths from one transport path to rotationally move the diversion member 21 between the two positions in accordance with the diversion control. The selector 46 is rotatably supported by the side plate 31 via the selector axis 47, the gear 54 is attached to the selector axis 47, and the gear 55 meshing with the gear 54 is attached to the rotary axis 20. Further, an operation axis 47*a* is projected to the side of the selector axis 47 of the selector 46.

The direction control driving unit 45 includes a solenoid 93 as a driving portion, one end of a link 95 is rotatably connected to a top end of a plunger 94 of the solenoid 93 by a link axis 95*a*, and the other end of the link 95 is rotatably connected to the operation axis 47*a* of the selector 46. The solenoid 93 suctions the plunger 94 by the power being turned on to reduce the projection size thereof, and resets the plunger 94 from being suctioned by the power being turned off. In the operation axis 47*a*, a tension spring 96 biasing the plunger 94 of the solenoid 93 in a direction to which the plunger projects is stretched.

As shown in FIG. 15(*a*), a position where the solenoid 93 is turned off, the plunger 94 is drawn out by bias of the tension spring 96 and the selector 46 comes into contact with a stopper 97 constituting the locking unit 69 and stops is set as a first position. Additionally, as shown in FIG. 15(*b*), a position where the solenoid 93 is turned on and the plunger 94 is completely pulled out against the bias of the tension spring 96 and stops, is set as a second position. The first and second positions correspond to correct stopping positions of the diversion member 21 which has switched the transport path to be subject to the diversion control.

As shown in FIG. 15(*a*), under the state where the solenoid 93 is turned off, the plunger 94 is drawn out by the bias of the tension spring 96, and the selector 46 comes into contact with a stopper 97 and stops at the first position, the acute tip 22 of the diversion member 21 is switched to the state where the acute tip 22 turns toward the direction of the one transport path. In this state, the selector 46 is driven by the diversion control, the diversion member 21 is rotationally moved between the two stopping positions, and the two transport passages can be switched with respect to one transport path.

By turning on the solenoid 93 in the state shown in FIG. 15(*a*), as shown in FIG. 15(*b*), the plunger 94 is moved to the second position, where the plunger 94 is completely pulled out against the bias of the tension spring 96 and stops, the selector 46 rotationally moves clockwise around the selector axis 47, the diversion member 21 rotationally moves counterclockwise together with the rotary axis 20 via the gears 54 and 55, and the acute tip 22 of the diversion member 21 is switched to the state where the acute tip 22 turned toward the direction of other transport paths.

By turning off the solenoid 93 in the state shown in FIG. 15(*b*), as shown in FIG. 15(*a*), the plunger 94 moves to the first position, where the plunger 94 is drawn out by the bias by the tension spring 96 and the selector 46 comes into contact with the stopper 97 and stops, the selector 46 rotationally moves counterclockwise around the selector axis 47, the diversion member 21 rotationally moves clockwise together with the rotary axis 20 via the gears 54 and 55, and the acute tip 22 of the diversion member 21 is switched to the state where the acute tip 22 turns toward the direction of the original one transport path.

Thus, the diversion control driving unit 44 for rotationally moving the diversion member 21 in accordance with the diversion control and the direction control driving unit 45 for rotationally moving the diversion member 21 in accordance with the direction control are provided, thereby the direction control and diversion control can be respectively suitably controlled.

The diversion control driving unit 44 regulates the rotational range of the diversion member 21 between two positions for switching two transport passages with respect to one transport path to rotationally move the diversion member 21 between the two positions in accordance with the diversion control, thereby high-speed switching can be performed and the stopping position of the diversion member 21 can be fixed.

In addition, the direction control driving unit 45 actuates the selector 46 by turning on/off the solenoid 93 to rotationally move the diversion member 21, thereby simplifying the constitution. Moreover, by making the first and second positions of the solenoid 93 correspond to the correct stopping position of the diversion member 21 which has switched the transport path to be subject to the diversion control, the direction control driving unit 45 can serve as the locking unit 69 and make the diversion member 21 stop accurately.

Moreover, in the sixth driving method, although transport paths in two directions to be subject to the diversion control are described above, transport paths in three or more directions to be subject to the diversion control can be adopted by, for example, using a multi-step solenoid such as a two-step solenoid.

As a driving portion, not limited to the linearly driving type solenoid 93 in which the plunger 94 advances/retreats, other configurations can be adopted so that a rotary solenoid which rotationally moves between two positions is used to directly rotationally move the selector axis 47; a motor and a gear mechanism are used to rotationally move the selector axis 47. Although the locking unit 69 may not be used in the case where a driving portion capable of stopping the diversion member 21 which has switched the transport paths to be subject to the diversion control, at two positions corresponding to the correct stopping positions, the locking unit 69 is required for positioning the diversion member in the case of using other driving portions.

Next, a first example of a driving method in the case of using a plurality of diverters 15 will be described with reference to FIG. 16.

The first example is adopted for, for example, a transport unit of a banknote depositing and dispensing machine. Three diverters 15 are used, any two of the transport paths in three directions (first transport path 11, second transport path 12 and third transport path 13 shown in FIG. 1) of the respective diverters 15 are connected to a vertically extending main transport path 100*a*, and the other transport path is connected to the diversion transport path 100*b* respectively connected to first to third storing units 101 to 103 which can feed and receive banknotes one by one and store banknotes for each denomination.

Banknotes in the transport unit are transported only from an upper side to a lower side in the vertically extending main transport path 100*a*, and bidirectionally transported in the diversion transport path 100*b* between the respective diverters 15 and the respective storing units 101 to 103. Accordingly, banknotes fed one by one from the respective storing units 101 to 103 are transported downward when dispensing banknotes from the respective storing units 101 to 103 as shown in FIG. 16(*a*), and banknotes transported from above are diverted for each denomination and stored in the respective storing units 101 to 103 in sorting and storing banknotes into the respective storing units 101 to 103 as shown in FIG. 16(*b*).

In this case, the second driving method shown in FIG. 6 can be used to drive the respective diverters 15. That is, as shown in FIG. 16(*c*), the endless synchronous belt 52 is placed around the synchronous pulley 50 of one stepping motor 49 and the synchronous pulley 51 of the respective diverters 15, the three synchronous pulleys 51 are integrally rotationally moved in the same direction by driving the stepping motor 49 by the direction control, and thus the diversion members 21 of the three diverters 15 are integrally rotationally moved in the same direction.

Figure 16:
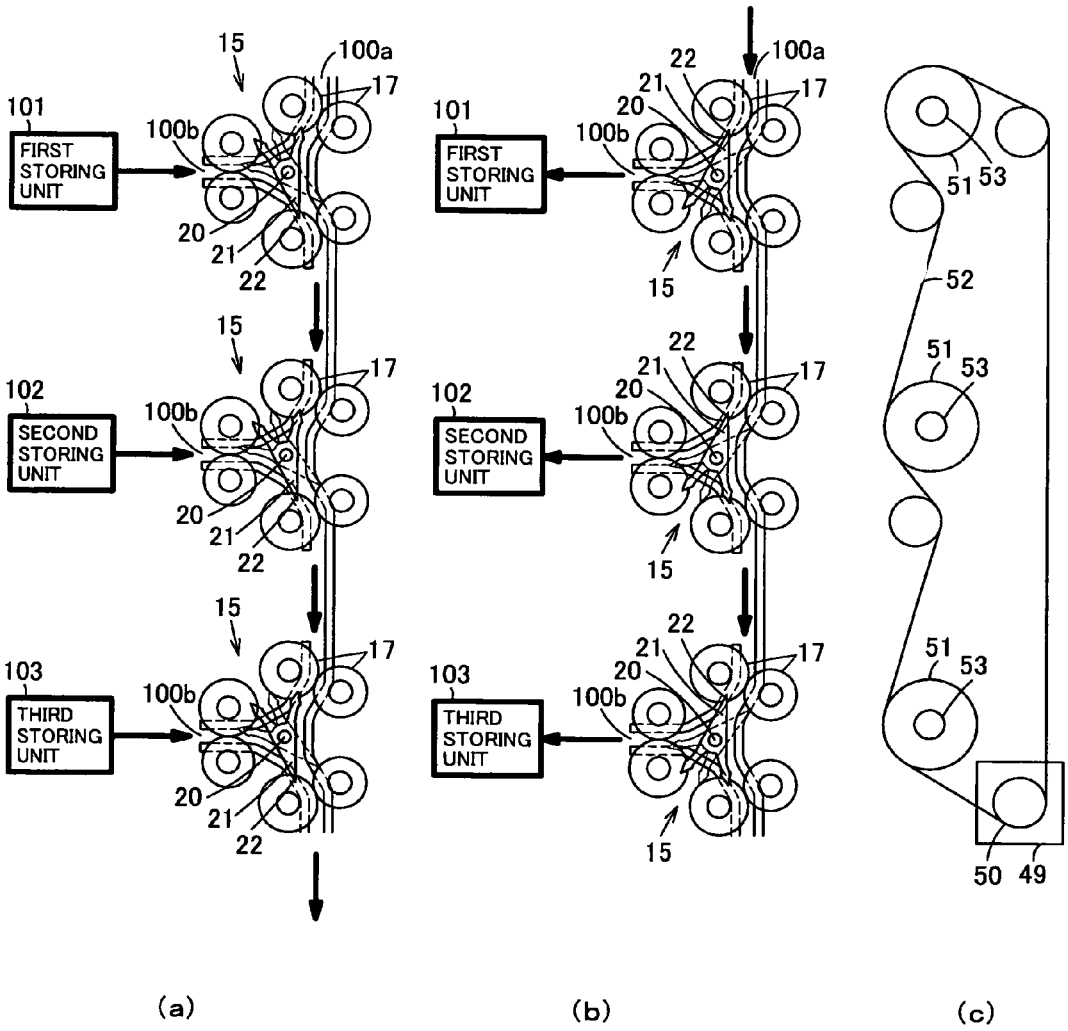
FIG. 16 shows a first example of a driving method in the case of using a plurality of paper sheet diverters, FIG. 16(*a*) is an explanatory view when dispensing, FIG. 16(*b*) is an explanatory view when sorting and storing, and FIG. 16(*c*) is a side view of a driving unit.

As shown in FIG. 16(*a*), when dispensing banknotes from the respective storing units 101 to 103, the stepping motor 49 is driven by the direction control so that the acute tip 22 of the respective diversion members 21 turns toward the lower transport path. In the respective diverters 15, when banknotes are fed from the corresponding storing units 101, 102 and 103, the diversion member 21 is switched to the transport passage for transporting banknotes to the lower transport path by the diversion control. On the other hand, in the lower two diverters 15, when banknotes transported from the upper side to the lower side in the main transport path 100*a* are made to pass through downward, the diversion members 21 are switched to the transport passage for making banknotes pass through downward by the diversion control, therefore, the respective diversion members 21 are switched by the diversion control to transport banknotes.

As shown in FIG. 16(*b*), in sorting and storing banknotes into the respective storing units 101 to 103, the stepping motor 49 is driven by the direction control and the acute tip 22 of the respective diversion members 21 turns toward the upper transport path. In the respective diverters 15, in the case of banknotes of a denomination to be diverted among banknotes continuously transported in the main transport path 100*a* from above, the diversion member 21 is switched to a transport passage for taking and storing the banknotes into the respective storing units 101, 102 and 103 by the diversion control. On the other hand, in the case of banknotes of a denomination not to be diverted, the diversion member 21 is switched to the transport passage for making the banknotes pass through downward by the diversion control, therefore, the respective diversion members 21 are switched by the diversion control to divert banknotes at high speed.

By using such diverter 15, the number of diverters can be reduced compared with the case of two-directional diverters fulfilling such a diversion function, and the direction control of the plurality of diversion members 21 can be collectively performed by integrally rotationally moving the plurality of synchronous pulleys 51 via the synchronous belt 52 by one stepping motor 49, thereby simplifying and downsizing the constitution.

Although the diversion control driving unit 44 is used in the above described methods, both the diversion control and direction control may be performed by one stepping motor 49 by removing the selector 46, the selector axis 47, the gears 54 and 55 and a bearing (bearing engaged with the axis 53) from the diverter 15 in the second driving method shown in FIG. 6 and directly connecting the synchronous pulley 51 and the axis 53.

Next, a second example of the driving method in the case of using a plurality of diverters 15 will be described with reference to FIGS. 17 to 19.

The second example is adopted for, for example, a transport unit of a banknote depositing and dispensing machine. Four diverters 15 are used, any two of the transport paths in three directions (first transport path 11, second transport path 12 and third transport path 13 shown in FIG. 1) of the respective diverters 15 are connected to the vertically extending main transport path 100*a*, and the other transport path is connected to the diversion transport paths 100*b* respectively connected to an escrow unit 104 and the first to third storing units 101 to 103 which can feed and receive banknotes one by one and store banknotes for each denomination. Banknotes in the transport unit are transported only from the upper side to the lower side in the vertically extending main transport path 100*a*, and bidirectionally transported in the diversion transport path 100*b* between the respective diverters 15 and the respective storing units 101 to 103.

In this case, the fifth driving method shown in FIG. 13 and FIG. 14 can be used to drive the respective diverters 15. In this case, a rotation position is out of alignment between the position of the recessed portion 89 of the cam 87 of the uppermost diverter 15 corresponding to the escrow unit 104 and those of the recessed portions 89 of the cams 87 of the lower three diverters 15 corresponding to the respective storing units 101 to 103.

Figure 17:
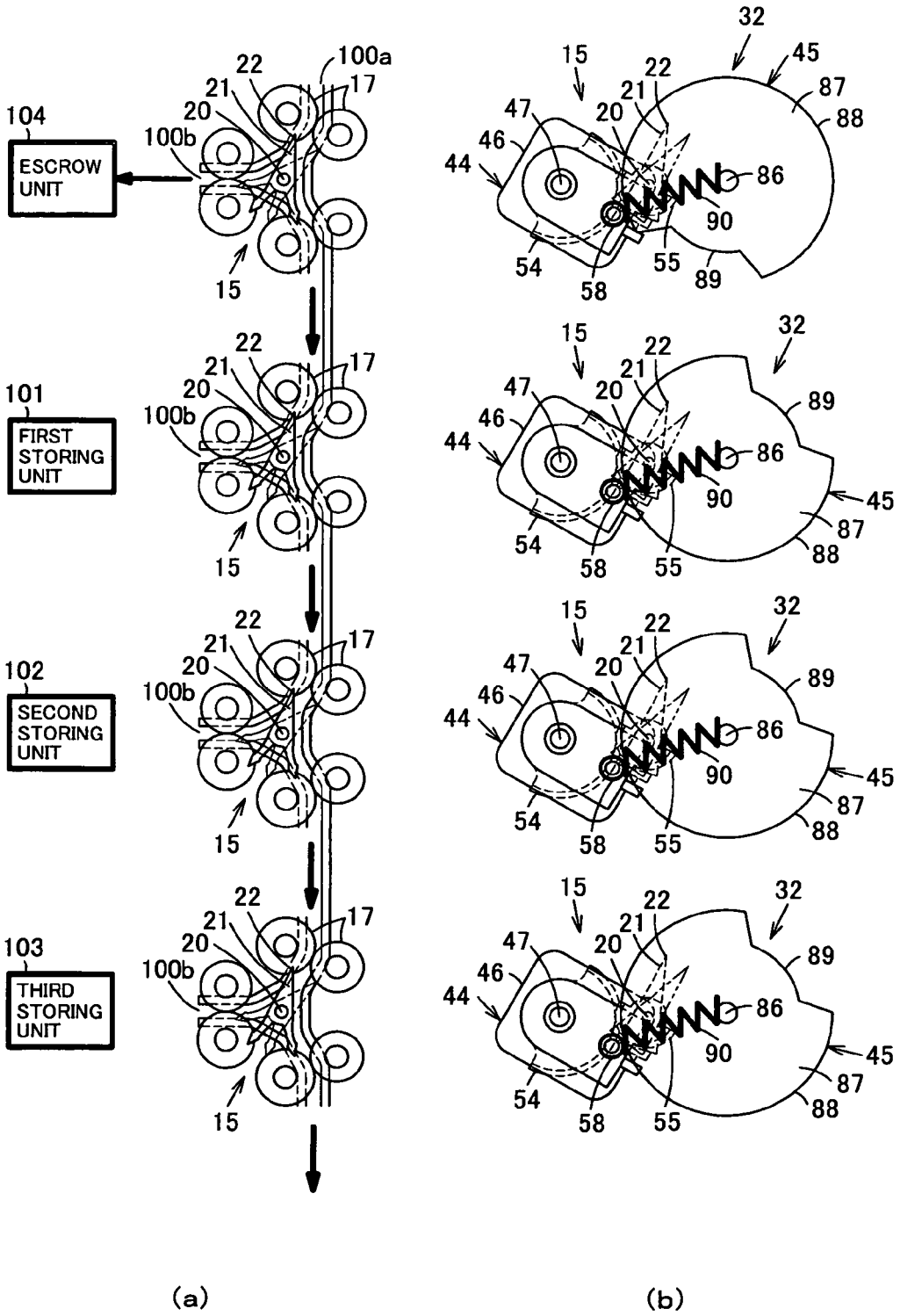
FIG. 17 shows a second example of a driving method in the case of using a plurality of paper sheet diverters, FIG. 17(*a*) is an explanatory view when depositing (reject return), and FIG. 17(*b*) is a side view of the respective paper sheet diverters.

As shown in FIG. 17, when depositing (reject return), the cam 87 is rotationally moved by the direction control to turn the acute tip 22 of the respective diversion members 21 toward the upper transport path. In the diverter 15 corresponding to the escrow unit 104, in the case of banknotes to be escrowed among banknotes continuously transported in the main transport path 100*a* from above, the diversion member 21 is switched to a transport passage for taking and storing the banknotes into the escrow unit 104 by the diversion control. On the other hand, in the case of rejected banknotes not to be escrowed, the diversion member 21 is switched to a transport path for making the banknotes pass through downward by the diversion control, therefore, the respective diversion members 21 are switched by the diversion control to divert banknotes at high speed. Additionally, in the respective diverters 15 corresponding to the respective storing units 101 to 103, the diversion member 21 is switched to a transport passage for making banknotes pass through downward by the diversion control.

Figure 18:
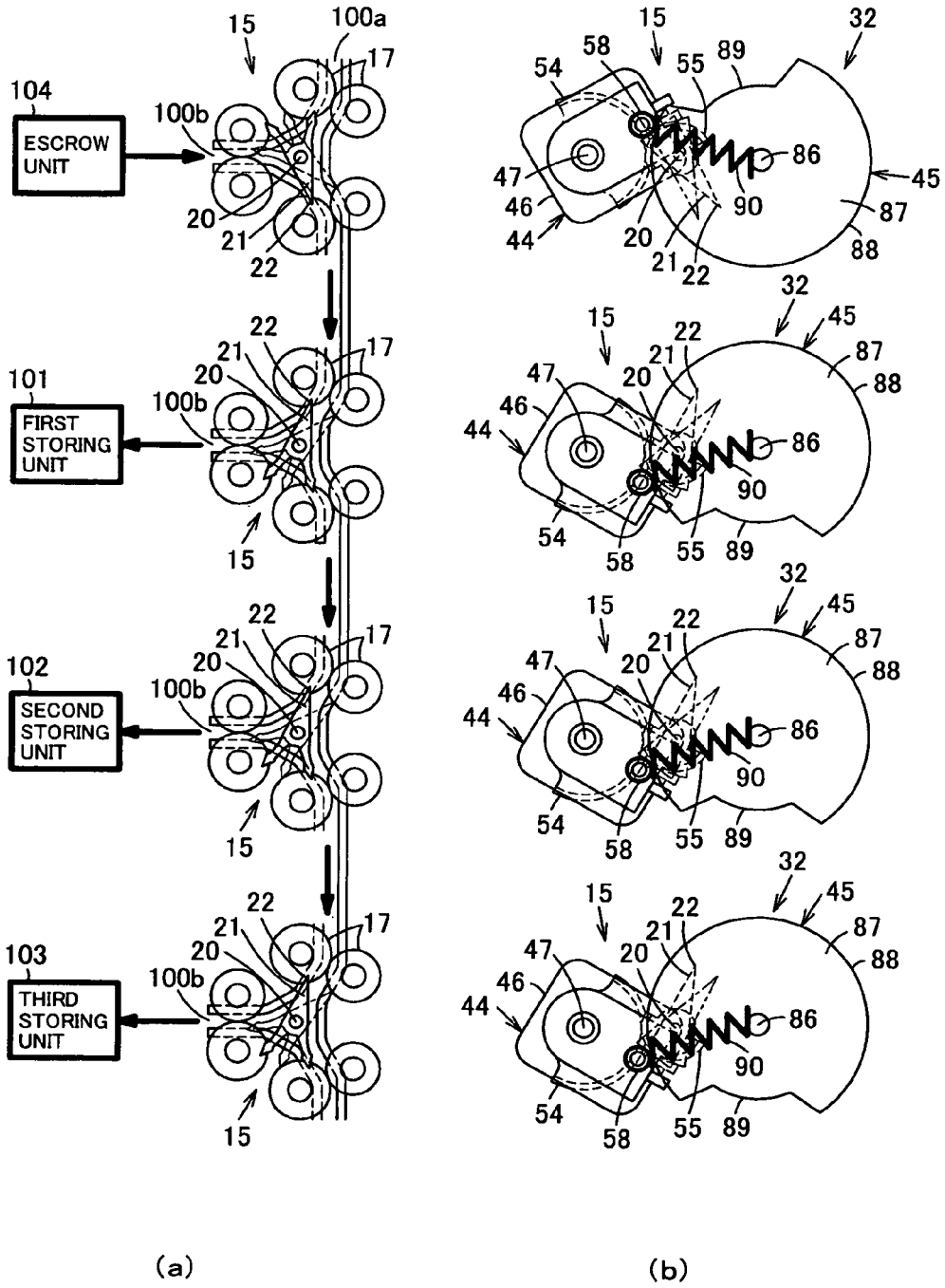
FIG. 18 shows the second example of the driving method in the case of using the plurality of above-described paper sheet diverters, FIG. 18(*a*) is an explanatory view when sorting and storing, and FIG. 18(*b*) is a side view of each paper sheet diverter.

As shown in FIG. 18, in sorting and storing banknotes escrowed in the escrow unit 104, in the diverter 15 corresponding to the escrow unit 104, the cam 87 is rotationally moved clockwise from, for example, a state shown in FIG. 16 by the direction control to turn the acute tip 22 of the diversion member 21 toward the lower transport path, and then the diversion member 21 is switched to a transport passage for making banknotes fed one by one from the escrow unit 104 pass through downward by the diversion control. Additionally, in the respective diverters 15 corresponding to the respective storing units 101 to 103, in the case of banknotes of a denomination to be diverted among banknotes fed from the escrow unit 104 and transported from above, the diversion member 21 is switched to the transport passage for taking and storing the banknotes into the corresponding storing units 101 to 103 by the diversion control. On the other hand, in the case of banknotes of a denomination not to be diverted, the diversion member 21 is switched to the transport passage for making banknotes pass through downward by the diversion control, therefore, the respective diversion members 21 are switched by the diversion control to divert banknotes at high speed.

Figure 19:
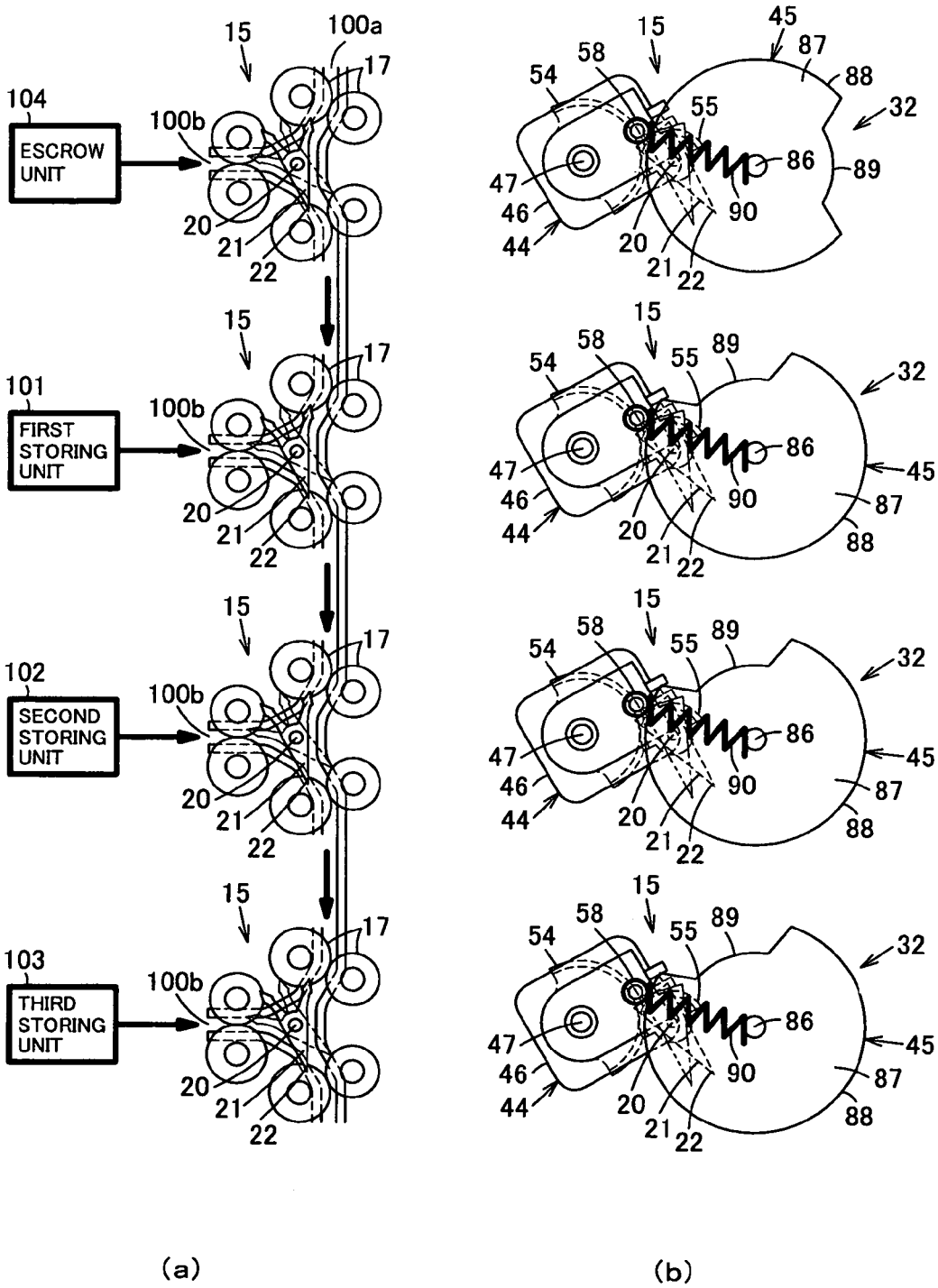
FIG. 19 shows the second example of the driving method in the case of using the plurality of above-described paper sheet diverters, FIG. 19(*a*) is an explanatory view when collecting, and FIG. 19(*b*) is a side view of each paper sheet diverter.

As shown in FIG. 19, when collecting banknotes stored in the respective storing units 101 to 103 including the escrow unit 104, in all diverters 15, the cam 87 is rotationally moved clockwise from, for example, a state shown in FIG. 18 by the direction control to turn the acute tip 22 of the diversion member 21 toward the lower transport path. In the respective diverters 15, when banknotes are fed from the corresponding escrow unit 104 and the respective storing units 101 to 103, the diversion member 21 is switched to the transport passage for transporting banknotes to the lower transport path by the diversion control. On the other hand, in the respective three diverters 15 of the respective storing units 101 to 103, when banknotes transported from the upper side to the lower side are made to pass through downward, the diversion member 21 is switched to the transport passage for making banknotes pass through downward by the diversion control, therefore, the respective diversion members 21 are switched by the diversion control to transport the banknotes.

In the case where the respective diverters 15 thus differently move, by using a driving method for combining positions of the direction control driving units 45 individually driving to perform the direction control, directions of the diversion members 21 can be arbitrarily controlled and the number of combinations can be increased.

Moreover, as the direction control driving units 45 individually driving, not only the fifth driving method shown in FIGS. 13 and 14, but also the fourth driving method shown in FIGS. 10 to 12, the third driving method shown in FIGS. 7 to 9, and the like may be used.

Next, a third example of the driving method using the plurality of diverters 15 will be described with reference to FIGS. 20 and 21.

The third example is adopted for, for example, a transport unit of a banknote depositing and dispensing machine. Diversion transport paths 108*a* to 108*d* respectively branch from four diversion positions a1 to a4, of a loop-shaped transport path 107, and the diversion member 21, the selector 46, the locking unit 69, etc., in the third driving method shown in FIGS. 7 to 9 are arranged, as a set, at the respective diversion positions a1 to a4. The respective diversion positions a1 to a4 are arranged relatively near each other and, for example, circumferentially, that is, the respective sets of diversion members 21 and selectors 46, etc., are circumferentially arranged. Moreover, with respect to the transport unit, any two of the first transport path 11, the second transport path 12, and the third transport path 13 shown in FIG. 1 correspond to the loop-shaped transport path 107 and the other one corresponds to the diversion transport path 108*a*, 108*b*, 108*c* or 108*d*, viewed from the respective diversion positions a1 to a4.

Although a cam 60 similar to that used in the third driving method is used for the direction control driving unit 45, the diameter of the cam 60 is larger than that used in the third driving method. The cam follower 58 of the respective selectors 46 is engaged with a cam groove 61 formed in one face of the cam 60. The constitution of the cam groove 61 is similar to that used in the third driving method, and the cam groove 61 includes: the outer circumference side cam groove portion 62; the inner circumference side cam groove portion 63; and the connection cam groove portion 64 for connecting the outer circumference side cam groove portion 62 and the inner circumference side cam groove portion 63. The cam 60 is driven forward/reverse by the motor 66.

As a detecting unit for detecting the rotation position of the cam 60, three light shielding ribs 111 are circumferentially projected at different radial positions of the other face of the cam 60, and there are disposed three photointerrupters 112 each having a floodlight unit and a light receiving unit on both sides of the respective light shielding ribs 111. By adjusting a forming range in a circumference direction of the respective light shielding ribs 111 and a position of the respective photointerrupters 112, the rotation position of the cam 60 can be detected based on a combination of light shielding and light transmission output of the three photointerrupters 112, that is, a direction of the direction control of the respective four diverters 15 can be detected. Since the direction control driving unit 45 is structured so as to rotationally move the respective diversion members 21 via the respective selectors 46 by rotation of the cam 60 and lock the respective diversion members 21, which have switched the transport path to be subject to the diversion control, at the stopping position of the respective diversion members 21 by the respective locking units 69, and the stopping position of the respective diversion members 21 is higher in accuracy even if the rotation position of the cam 60 is lower in accuracy. Accordingly, such a detecting unit is sufficiently applicable.

Figure 20:
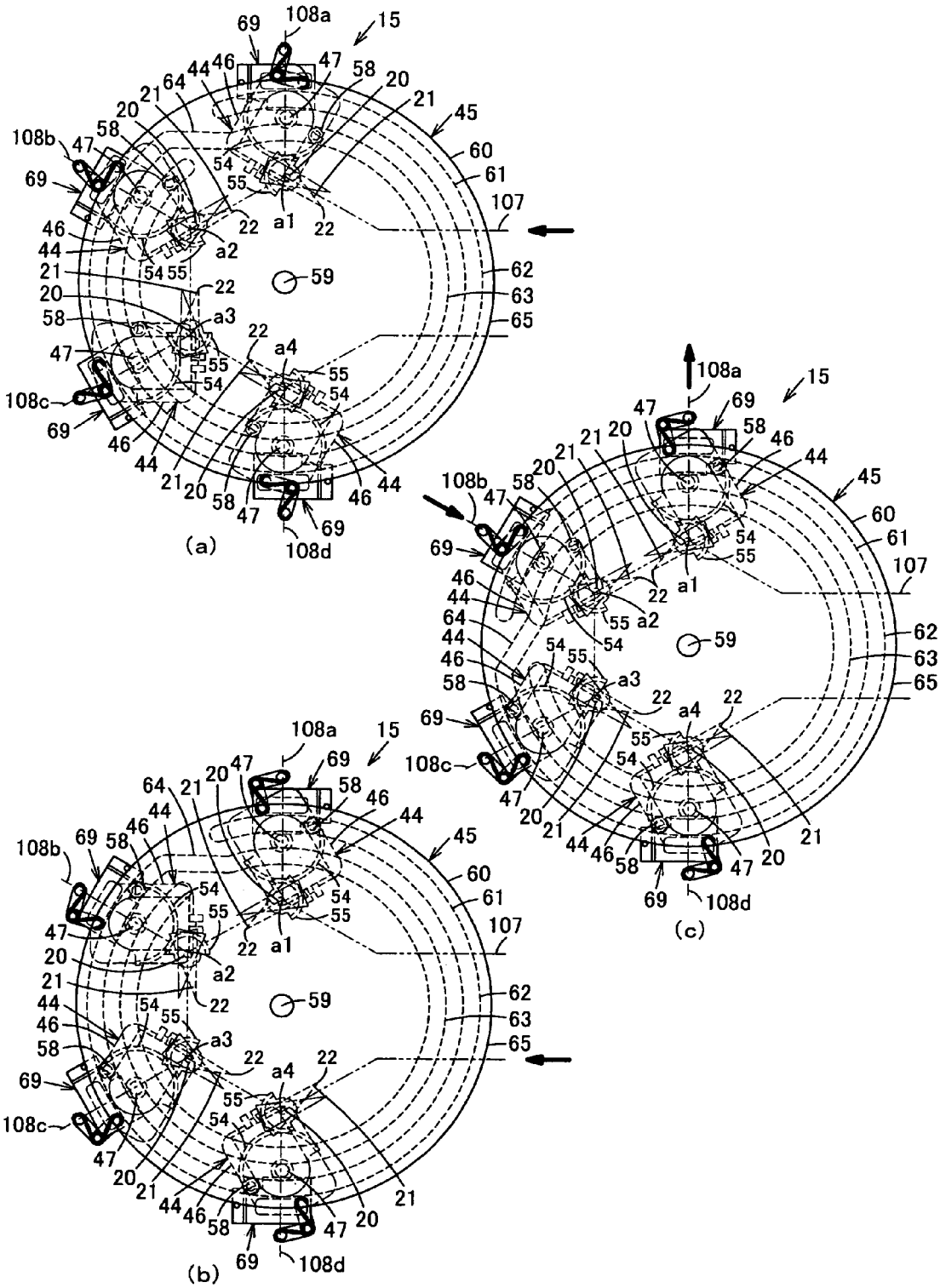
FIG. 20 shows the third example of the driving method in the case where a plurality of diversion members are used, and FIGS. 20(*a*), (*b*) and (*c*) are side views showing the state where the diversion members have been switched by the direction control.
Figure 21:
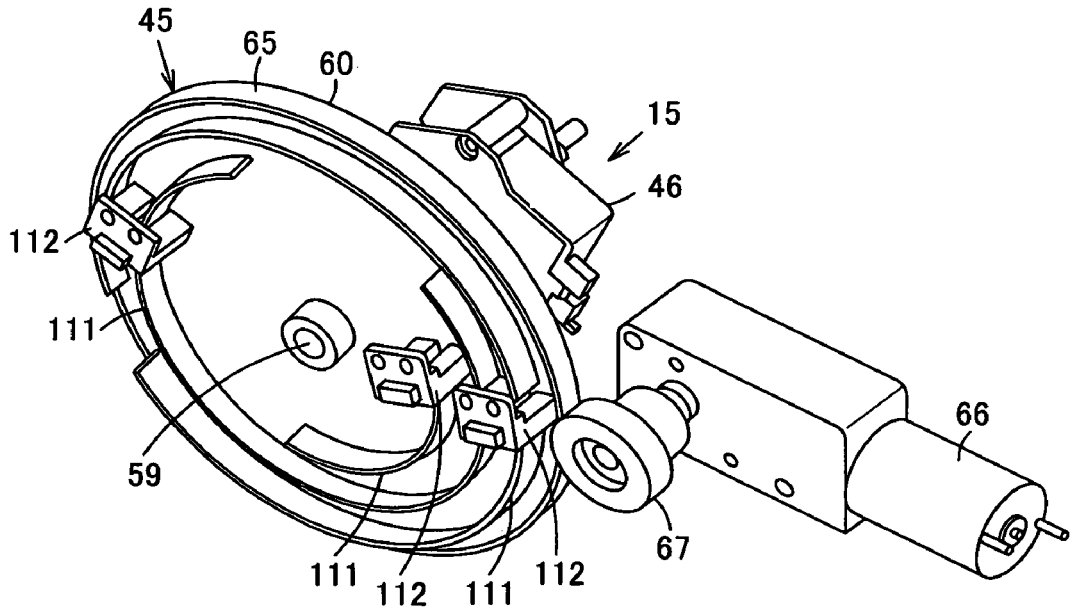
FIG. 21 is a perspective view showing a structure for detecting the positions at which the direction control of the plurality of diversion members are switched in the third example of the above-described driving method.

As shown in FIG. 20(*a*), in a state where the cam follower 58 of the respective selectors 46 is engaged with the inner circumference side cam groove portion 63 of the cam 60, the acute tip 22 of the respective diversion members 21 turns in one direction of the loop-shaped transport path 107. In this state, the respective selectors 46 are driven by the diversion control, and the respective diversion members 21 are rotationally moved between the two stopping positions, thereby banknotes can be diverted at high speed by switching between the transport passage for diverting banknotes transported from the one direction of the loop-shaped transport path 107 to the respective diversion transport paths 108*a* to 108*d* and the transport passage for making banknotes transported from the one direction of the loop-shaped transport path 107 pass through to the downstream side of the loop-shaped transport path 107.

By making one clockwise rotation of the cam 60 shown in FIG. 20(*a*), the respective cam followers 58 are engaged with the outer circumference side cam groove portion 62 from the inner circumference side cam groove portion 63 through the connection cam groove portion 64. Thus, as shown in FIG. 20(*b*), the respective selectors 46 rotationally move counterclockwise around the selector axis 47, the diversion member 21 rotationally moves clockwise together with the rotary axis 20 via the gears 54 and 55, and the acute tip 22 of the diversion member 21 is switched to the state where the acute tip 22 turns toward the other direction of the loop-shaped transport path 107. In this state, the respective selectors 46 are driven by the diversion control, the respective diversion members 21 are rotationally moved between the two stopping positions, thereby banknotes can be diverted at high speed by switching between the transport passage for diverting banknotes transported from the other direction of the loop-shaped transport path 107 to the respective diversion transport paths 108*a* to 108*d* and the transport passage for making banknotes transported from the one direction of the loop-shaped transport path 107 pass through to the downstream side of the loop-shaped transport path 107.

Additionally, in the state shown in FIG. 20(*b*), the connection cam groove portion 64 of the cam 60 is located between the selector 46 at the diversion positional and the selector 46 at the adjacent diversion position a2. Then, as shown in FIG. 20(*c*), by rotationally moving the cam 60 counterclockwise so that the connection cam groove portion 64 passes through only the selector 46 at the diversion position a2, the cam follower 58 of the selector 46 at the diversion position a2 is engaged with the inner circumference side cam groove portion 63 from the outer circumference side cam groove portion 62 through the connection cam groove portion 64. Thus, the selector 46 at the diversion position a2 rotationally moves clockwise around the selector axis 47, the diversion member 21 rotationally moves counterclockwise together with the rotary axis 20 via the gears 54 and 55, and the acute tip 22 of the diversion member 21 is switched to the state where the acute tip 22 turns toward one direction of the loop-shaped transport path 107. In this state, a transport passage can be formed for transporting banknotes transported from the diversion transport path 108*b* at the diversion position a2, to the diversion transport path 108*a* at the diversion positional through the loop-shaped transport path 107.

As described above, in the case of driving the plurality of sets of diversion members 21, the respective diversion members 21 thus can be rotationally moved via the respective cam followers 58 engaged with the cam groove 61 of the cam 60 and the respective selectors 46 by rotation of one cam 60, thereby simplifying and downsizing the constitution.

Moreover, only a specified diversion member 21 among the plurality of diversion members 21 can be subject to the direction control, and an application range can be widened.

In addition, although the case where the diverters 15 are arranged on the same circumference is described above, the diverters 15 not arranged on the same circumference can be controlled by providing another cam groove.

The disk-shaped cam 60 having the cam groove 61 is described above as a switch body. Since the locking unit 69 is provided, any type of cam such as a lever-shaped cam may be used as long as it is provided with at least a part of the connection cam groove 64.

Next, a fourth example of the driving method in the case of using the plurality of diverters 15 will be described with reference to FIG. 22.

The fourth example is adopted for, for example, a transport unit of a banknote depositing and dispensing machine. Diversion transport paths 108*a* to 108*d* respectively branch from four diversion positions a1 to a4 of a loop-shaped transport path 107, and the diversion member 21 and the selector 46, etc., in the fifth driving method shown in FIGS. 13 and 14 are arranged, as a set, at the respective diversion positions a1 to a4. The respective diversion positions a1 to a4 are arranged relatively near each other and, for example, circumferentially, that is, the respective sets of diversion members 21 and the selectors 46, etc., are circumferentially arranged. Moreover, in the respective diverters 15, any two of the first transport path 11, the second transport path 12, and the third transport path 13 shown in FIG. 1 correspond to the loop-shaped transport path 107 and the other one corresponds to the diversion transport paths 108*a*, 108*b*, 108*c* and 108*d*, viewed from the respective diversion positions a1 to a4.

A cam 87 similar to that used in the fifth driving method is used for the direction control driving unit 45, the diameter of the cam 87 is larger than that used in the fifth driving method. The cam follower 58 of the respective selectors 46 is engaged with a cam face 88 of the outer circumference of the cam 87. The constitution of the cam 87 is similar to that used in the fifth driving method, the cam face 88 is a disk around the cam axis 86, the recessed portion 89 is formed at one place of the cam face 88. The respective tension springs 90 as a biasing unit are stretched between the axis of the cam follower 58 of the respective selectors 46 and the cam axis 86. A motor (not shown) as a driving portion for rotationally driving the cam 87 is connected to the cam axis 86. Although the cam face 88 of the cam 87 comes into contact with the cam follower 58 of the respective selectors 46, the recessed portion 89 is disposed so as not to come into contact with the cam follower 58.

Moreover, in order to detect a rotation position of the cam 87, a detecting unit (not shown) using, for example, a light shielding plate and a photointerrupter is used.

Figure 22:
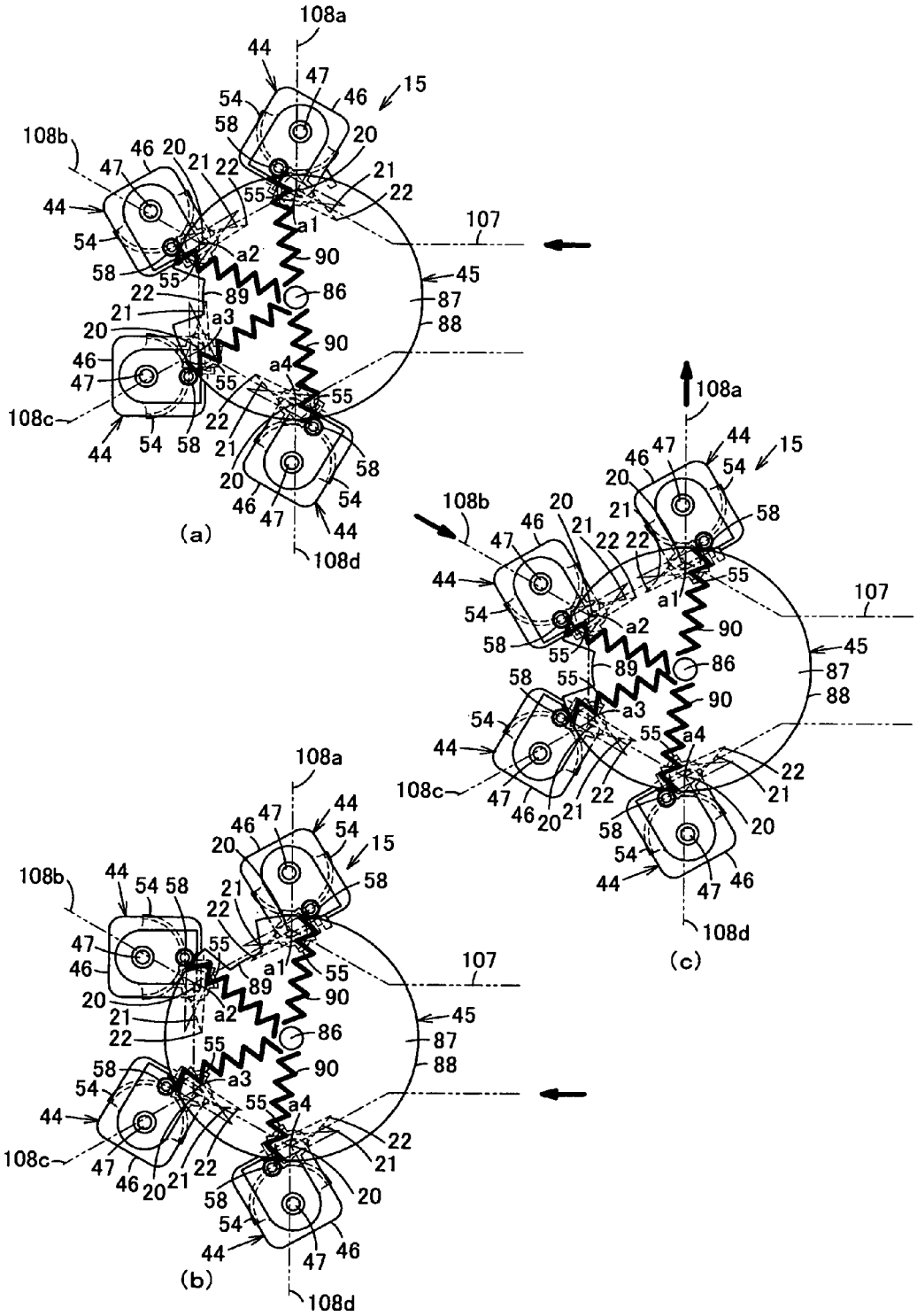
FIG. 22 shows a fourth example of the driving method in the case where a plurality of diversion members 15 are used, and FIGS. 22(*a*), (*b*) and (*c*) are side views showing the state where the diversion members 15 have been switched by the direction control.

As shown in FIG. 22(*a*), in a state where the cam follower 58 of the respective selectors 46 is engaged with the cam face 88 of the outer circumference of the cam 87, the acute tip 22 of the respective diversion members 21 turns toward one direction of the loop-shaped transport path 107. In this state, the respective selectors 46 are driven by the diversion control, the respective diversion members 21 are rotationally moved between the two stopping positions, thereby banknotes can be diverted at high speed by switching between the transport passage for diverting banknotes transported from the one direction of the loop-shaped transport path 107 to the respective diversion transport paths 108*a* to 108*d* and the transport passage for making banknotes transported from the one direction of the loop-shaped transport path 107 pass through to the downstream side of the loop-shaped transport path 107.

By rotating the cam 87 clockwise shown in FIG. 22(*a*), the cam follower 58 enters the recessed portion 89 of the cam 87 and is pushed by one side edge of the recessed portion 89 of the cam 87, the selector 46 is rotationally moved counterclockwise around the selector axis 47, and the cam face 88 located at one side of the recessed portion 89 of the cam 87 comes into contact with the cam follower 58. Accordingly, as shown in FIG. 22(*b*), by making at least one clockwise rotation of the cam 87 (FIG. 22(*b*) shows a state where the cam 87 is rotated two or more times), the respective selectors 46 rotationally move counterclockwise around the selector axis 47, the diversion member 21 rotationally moves clockwise together with the rotary axis 20 via the gears 54 and 55, and the acute tip 22 of the diversion member 21 is switched to the state where the acute tip 22 turns toward the other direction of the loop-shaped transport path 107. In this state, the respective selectors 46 are driven by the diversion control, the respective diversion members 21 are rotationally moved between the two stopping positions, thereby banknotes can be diverted at high speed by switching between the transport passage for diverting banknotes transported from the other direction of the loop-shaped transport path 107 to the respective diversion transport paths 108*a* to 108*d* and the transport passage for making banknotes transported from the other direction of the loop-shaped transport path 107 pass through to the downstream side of the loop-shaped transport path 107.

Additionally, in the state shown in FIG. 22(*b*), the recessed portion 89 of the cam 87 is located between the selector 46 at the diversion position a2 and the selector 46 at the diversion position a3. Then, as shown in FIG. 22(*c*), by rotationally moving the cam 87 counterclockwise so that the recessed portion 89 passes through only the selector 46 at the diversion position a2, the cam follower 58 of the selector 46 at the diversion position a2 enters the recessed portion 89 of the cam 87 and is pushed by the other end edge of the recessed portion 89 of the cam 87, the selector 46 at the diversion position a2 is rotationally moved clockwise around the selector axis 47, the cam face 88, which is located on the other side of the recessed portion 89 of the cam 87, comes into contact with the cam follower 58, and the acute tip 22 of the diversion member 21 is switched to the state where the acute tip 22 turns toward one direction of the loop-shaped transport path 107. In this state, there can be formed a transport passage for transporting banknotes transported from the diversion transport path 108*b* at the diversion position a2 to the diversion transport path 108*a* at the diversion positional through the loop-shaped transport path 107.

As described above, in the case of driving the plurality of sets of diversion members 21, the respective diversion members 21 thus can be rotationally moved via the respective cam followers 58 engaged with the cam 87 and the respective selectors 46 by rotation of one cam 87, thereby simplifying and downsizing the constitution.

Moreover, only a specified diversion member 21 among the plurality of diversion members 21 can be subject to the direction control, and an application range of the fourth example can be widened.

Although an outer circumference face of a plate cam is described above as being used as a cam face, another form using the outer circumference and the inner circumference in a groove of a groove cam as a cam face may be used.

Next, FIGS. 23 to 28 show an example of a paper sheet processing apparatus to which the diverter 15 is applied.

Figure 23:
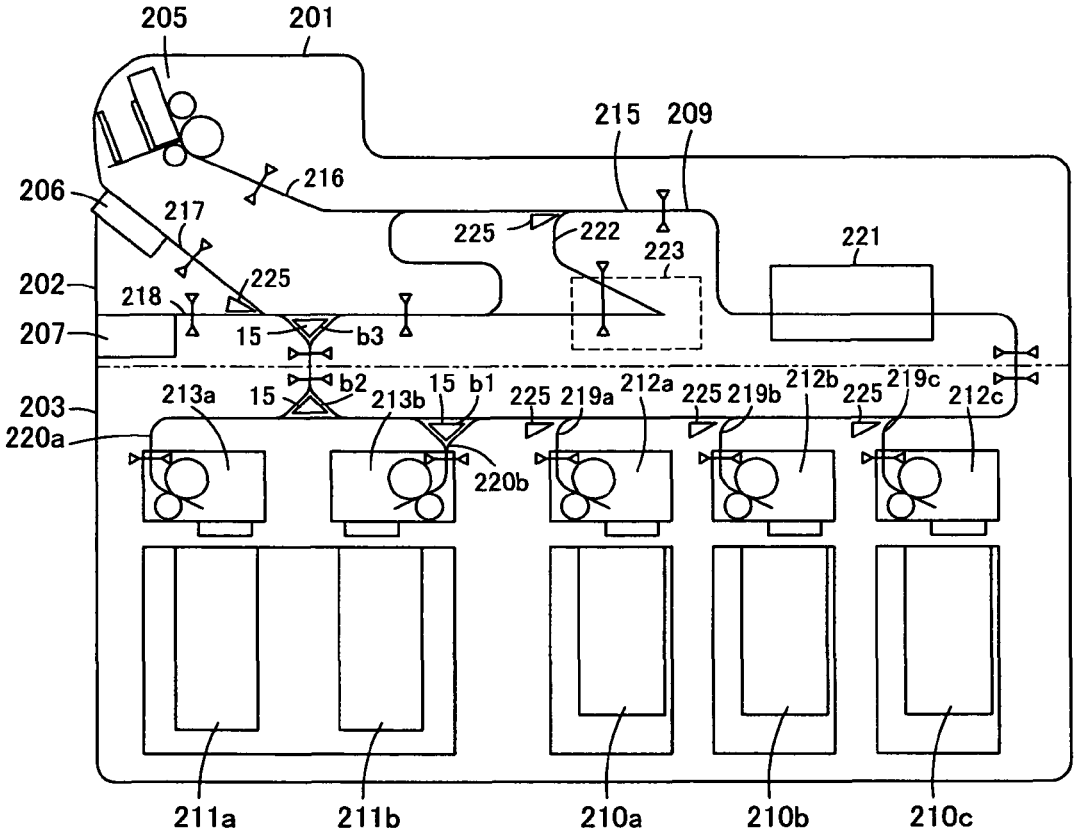
FIG. 23 is a cross sectional view showing an inner structure of an example of a paper sheet processing apparatus to which the diverters are applied.

As shown in FIG. 23, the paper sheet processing apparatus is, for example, a banknote depositing and dispensing unit for depositing and dispensing banknotes. The banknote depositing and dispensing unit includes an upper unit 202 and a lower unit 203 which can be drawn out from a front face of a unit body 201.

An inlet 205 for depositing banknotes and an outlet 206 for dispensing banknotes are disposed at an upper portion of the front face of the upper unit 202, and a reject box 207 for storing rejected banknotes is disposed attachably to and detachably from the front face of the upper unit 202.

A transport unit 209 for transporting banknotes is disposed throughout the upper unit 202 and the lower unit 203 in the unit body 201. In the lower unit 203, stackers 210*a* to 210*c* for storing banknotes for each denomination are juxtaposed in the back-forth direction, cassettes 211*a* and 211*b* for storing banknotes are disposed in the back-forth direction at the front side of the respective stackers 210*a* to 210*c*, a plurality of escrow units 212*a* to 212*c* are disposed above the respective stackers 210*a* to 210*c*, and escrow units 213*a* and 213*b* are disposed above the respective cassettes 211*a* and 211*b*.

The transport unit 209 is constituted by a belt mechanism, roller mechanism, etc., for transporting banknotes, and has a loop-shaped transport path 215, in which banknotes can be bidirectionally transported, throughout the upper unit 202 and the lower unit 203. In the loop-shaped transport path 215, a direction in which banknotes are transported clockwise in FIG. 23 is called "normal direction," and a direction in which banknotes are transported counterclockwise in FIG. 23 is called "reverse direction." To the loop-shaped transport path 215, in the upper unit 202, a deposit and transport path 216 from the inlet 205, a dispensing and transport path 217 to the outlet 206, and a reject transport path 218 to the reject box 207 are connected, and in the lower unit 203, stacker transport paths 219*a* to 219*c* to the escrow units 212*a* to 212*c* of the respective stackers 210*a* to 210*c*, and cassette transport paths 220*a* and 220*b* to the escrow units 213*a* and 213*b* of the respective cassettes 211*a* and 211*b* are connected. Additionally, on the loop-shaped transport path 215, a recognition unit 221 for recognizing transported banknotes is disposed between the deposit and transport path 216 and the rearmost stacker transport path 219*c*, a face/back reversing transport path 222 is connected between the recognition unit 221 and the dispensing and transport path 217, and a face/back reversing unit 223 for reversing the face/back of banknotes is disposed on the face/back reversing transport path 222.

On the loop-shaped transport path 215, the respective diverters 15 having either one of the constitutions of the diverter 15 used in the respective embodiments described above are disposed at the respective diversion positions b1 and b2 between the respective cassette transport paths 220*a* and 220*b*, and a diversion position b3 between the dispensing and transport path 217 and the reject transport path 218. Additionally, common two-directional diverters 225 are disposed at a diversion position between the dispensing and transport path 217 and the reject transport path 218, respective diversion positions to the respective stacker transport paths 219*a* to 219*c* and a diversion position between the face/back reversing transport path 222, respectively. Moreover, in the respective diverters 15, any two of the first transport path 11, second transport path 12, and third transport path 13 shown in FIG. 1 correspond to the loop-shaped transport path 215 and the other transport path corresponds to the diversion path 220*a*, the diversion path 220*b*, and the dispensing and transport path 217, viewed from the respective diversion positions b1 to b3.

The stackers 210*a* to 210*c* and the cassettes 211*a* and 211*b* can receive and store banknotes from the escrow units 212*a* to 212*c* and the escrow units 213*a* and 213*b*, send the stored banknotes to the escrow units 212*a* to 212*c* and the escrow units 213*a* and 213*b* located above, and can send out the banknotes from the escrow units 212*a* to 212*c* and the escrow units 213*a* and 213*b* to the transport unit 209. The cassettes 211*a* and 211*b* can be attached to and detached from the unit body 201.

The escrow units 212*a* to 212*c* and escrow units 213*a* and 213*b* escrow the banknotes sent from the transport unit 209 in the stacked state. By these escrow units, when storing, the stacked banknotes can be sent and stored in the stackers 210*a* to 210*c* and the cassettes 211*a* and 211*b* located below, and when returning, the stacked banknotes can be fed one by one to the transport unit 209. Additionally, banknotes sent from the stackers 210*a* to 210*c* and the cassettes 211*a* and 211*b* can be fed one by one to the transport unit 209.

Next, a depositing process of the banknote depositing and dispensing unit will be described with reference to FIG. 24 (a main transport passage of banknotes is indicated by the bold lines).

Figure 24:
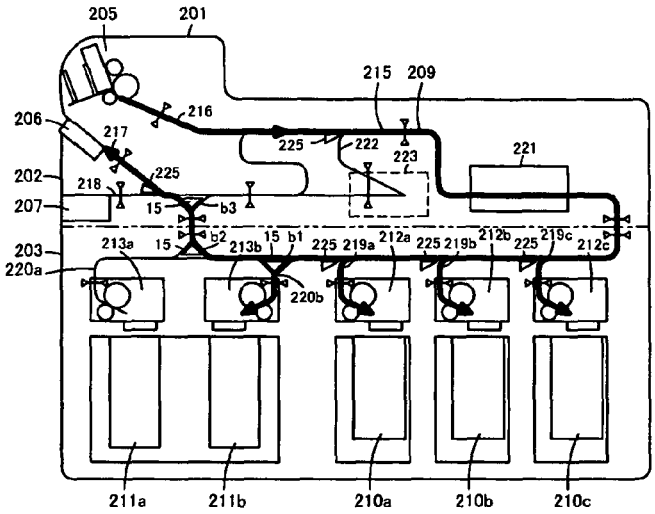
FIG. 24 shows a depositing process of the above-described paper sheet processing apparatus, FIG. 24(*a*) is an explanatory view showing a counting operation of the depositing process, FIG. 24(*b*) is an explanatory view showing a recounting operation of the depositing process, and FIG. 24(*c*) is an explanatory view showing a return operation of the depositing process.
Figure 24:
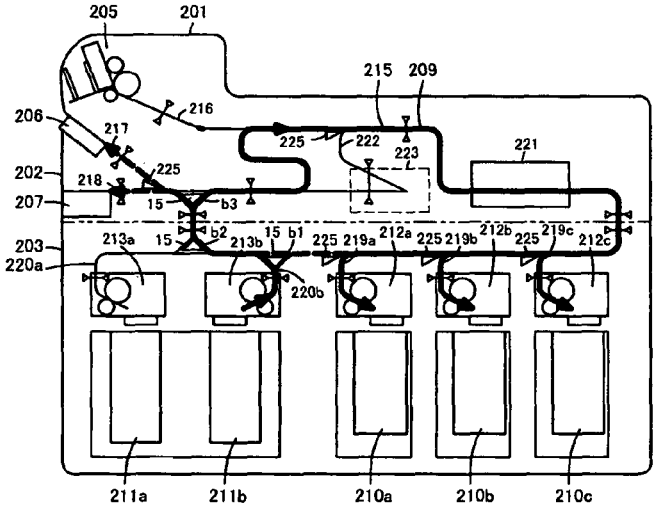
Figure 24:
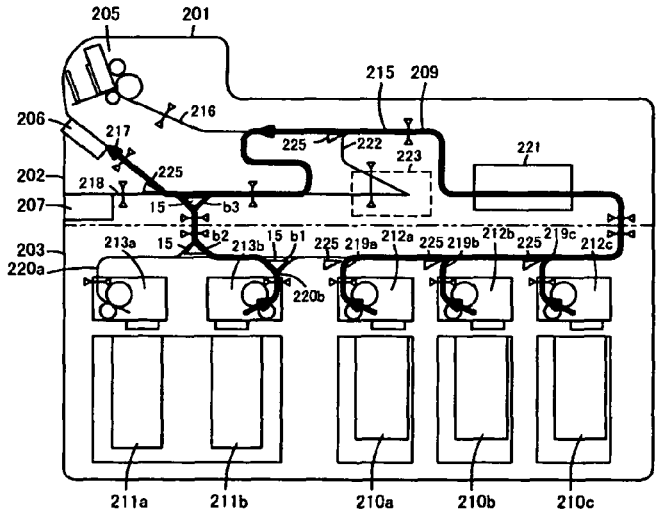

As shown in FIG. 24(*a*), banknotes input in the inlet 205 are sent one by one to the loop-shaped transport path 215 from the deposit and transport path 216, transported in the normal direction of the loop-shaped transport path 215 and recognized by the recognition unit 221.

Banknotes recognized as normal by the recognition unit 221 are diverted for each denomination from the loop-shaped transport path 215 to the stacker transport paths 219*a* to 219*c* by the two-directional diverters 225, and escrowed in the denomination-specific escrow units 212*a* to 212*c* in the stacked state.

When banknotes cannot be performed for a predetermined recognition operation by the recognition unit 221 because the transported banknotes are stacked and are recognized as re-recognizable banknotes which may be recognized as normal by re-recognition, the re-recognizable banknotes are diverted from the loop-shaped transport path 215 to the cassette transport path 220*b* via the diverter 15 at the diversion position b1, and escrowed in the escrow unit 213*b* in the stacked state.

In addition, when banknotes are recognized as rejected banknotes which are not normal and un-re-recognizable by the recognition unit 221, the rejected banknotes are diverted from the loop-shaped transport path 215 to the dispensing and transport path 217 via the respective diverters 15 at the diversion positions b1, b2 and b3 and the two-directional diverter 225, and sent to the outlet 206 for returning.

In the depositing process, the diverter 15 at the diversion position b1 performs high-speed diversion operation by the diversion control in order to divert re-recognizable banknotes transported in the normal direction of the loop-shaped transport path 215 to the cassette transport path 220*b* and to make rejected banknotes pass through to the downstream side of the loop-shaped transport path 215.

When re-recognizable banknotes are escrowed in the escrow unit 213*b* after banknotes are completely fed from the inlet 205, transport of the banknotes from the transport unit 209 is completed and the recognition unit 221 no longer detects any banknotes for a predetermined time, as shown in FIG. 24(*b*), banknotes in the escrow unit 213*b* are fed one by one to the cassette transport path 220*b*, sent to the loop-shaped transport path 215 via the diverter 15 at the diversion position b1, transported in the normal direction of the loop-shaped transport path 215 to the recognition unit 221 via the respective diverters 15 at the diversion positions b2 and b3 for re-recognition.

Banknotes recognized as normal as a result of re-recognition are diverted, for each denomination, from the loop-shaped transport path 215 to the stacker transport paths 219*a* to 219*c* by the two-directional diverters 225, and escrowed in the denomination-specific escrow units 212*a* to 212*c* in the stacked state. Additionally, when un-re-recognizable rejected banknotes are recognized, if banknotes still remain in the escrow unit 213*b*, feeding of banknotes is temporarily stopped, and the rejected banknotes are diverted from the loop-shaped transport path 215 to the dispensing and transport path 217 via the respective diverters 15 at the diversion positions b1, b2 and b3 and the two-directional diverter 225 and sent to the outlet 206 for returning.

When a depositing storing instruction is issued after the banknotes including the re-recognized banknotes are completely escrowed and the un-re-recognizable rejected banknotes are completely returned, the banknotes escrowed in the escrow units 212*a* to 212*c* are stored in the stackers 210*a* to 210*c* located below.

When a deposit return instruction is issued, as shown in FIG. 24(*c*), the banknotes escrowed in the escrow units 212*a* to 212*c* are fed for each denomination one by one from the escrow units 212*a* to 212*c* to the stacker transport paths 219*a* to 219*c*, sent to the loop-shaped transport path 215, transported in the reverse direction of the loop-shaped transport path 215, recognized by the recognition unit 221, and sent to the outlet 206 from the loop-shaped transport path 215 via the diverter 15 at the diversion position b3 and the two-directional diverter 225 for returning. When the re-recognizable banknotes are escrowed in the escrow unit 213*b*, the banknotes in the escrow unit 213*b* are fed one by one to the cassette transport path 220*b*, sent to the loop-shaped transport path 215 via the diverter 15 at the diversion position b1, transported in the normal direction in the loop-shaped transport path 215, and sent to the outlet 206 via the respective diverters 15 at the diversion positions b2 and b3 and the two-directional diverter 225 for returning.

Figure 25:
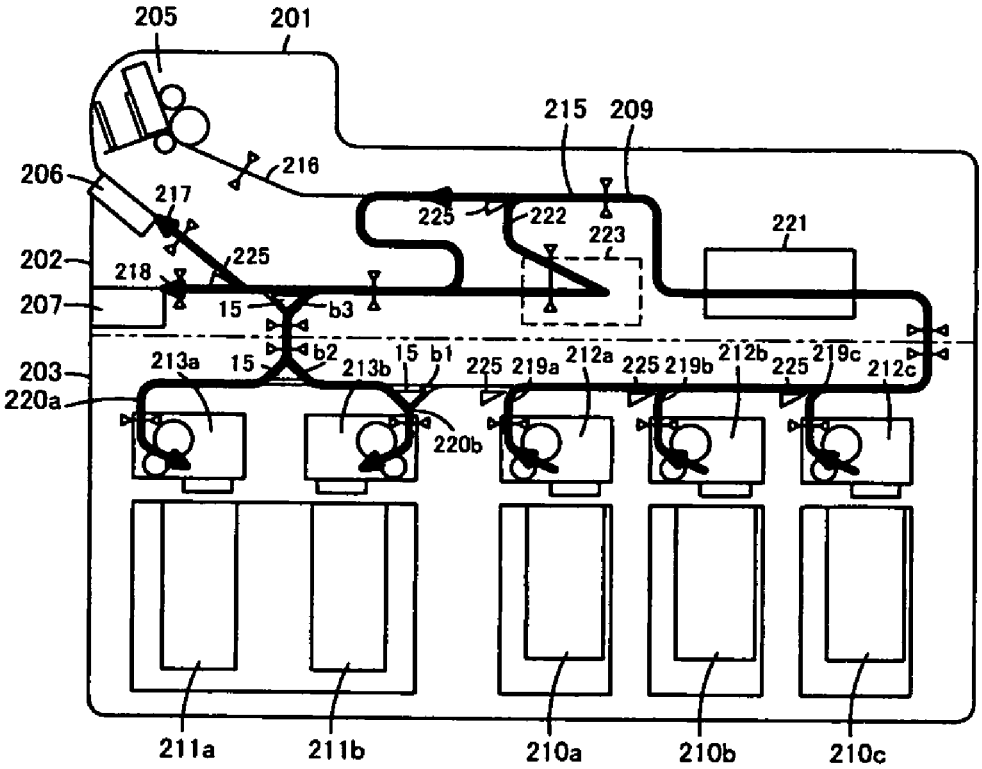
FIG. 25 is an explanatory view showing a dispensing process of the above-described paper sheet processing apparatus.

Next, a dispensing process will be described with reference to FIG. 25.

In the dispensing process, the banknotes stored in the stackers 210*a* to 210*c* of denominations to be dispensed are fed one by one from the escrow units 212*a* to 212*c* to the stacker transport paths 219*a* to 219*c*, sent to the loop-shaped transport path 215, transported in the reverse direction of the loop-shaped transport path 215 and recognized by the recognition unit 221.

Banknotes recognized as normal as a result of recognition are, if necessary, located by the face/back reversing unit 223 so that the front or back of the banknotes faces in the predetermined direction, and sent to the outlet 206 via the diverter 15 at the diversion position b3 and the two-directional diverter 225 from the loop-shaped transport path 215.

When a predetermined recognition operation cannot be performed by the recognition unit 221 because transported banknotes are stacked, and the banknotes are recognized as re-recognizable banknotes which may be recognized as normal by re-recognition, the re-recognizable banknotes are diverted from the loop-shaped transport path 215 to the cassette transport path 220*a* via the respective diverters 15 at the diversion position b3 and b2 or to the cassette transport path 220*b* via the diverter 15 at the diversion position b1, and escrowed in one of the escrow units 213*a* and 213*b* in the stacked state.

In addition, when banknotes are recognized as rejected banknotes which are not normal and un-re-recognizable by the recognition unit 221, the rejected banknotes are diverted from the loop-shaped transport path 215 to the reject transport path 218 via the diverter 15 at the diversion position b3 and the two-directional diverter 225, and sent to the reject box 207 for storing.

Banknotes of an insufficient denomination due to the occurrence of re-recognizable banknotes or rejected banknotes are re-fed from the corresponding stackers 210*a* to 210*c*. When re-recognizable banknotes are stored in either of the escrow units 213*a* and 213*b*, re-recognition operation similar to that in the depositing process shown in FIG. 24(*b*) is performed after the dispensing process is completed.

Next, an initial replenishment process will be described with reference to FIG. 26.

In the initial replenishment process, banknotes are replenished in the stackers 210*a* to 210*c* storing no banknotes from the cassettes 211*a* and 211*b* which store banknotes to be replenished installed in the unit body 201.

Figure 26:
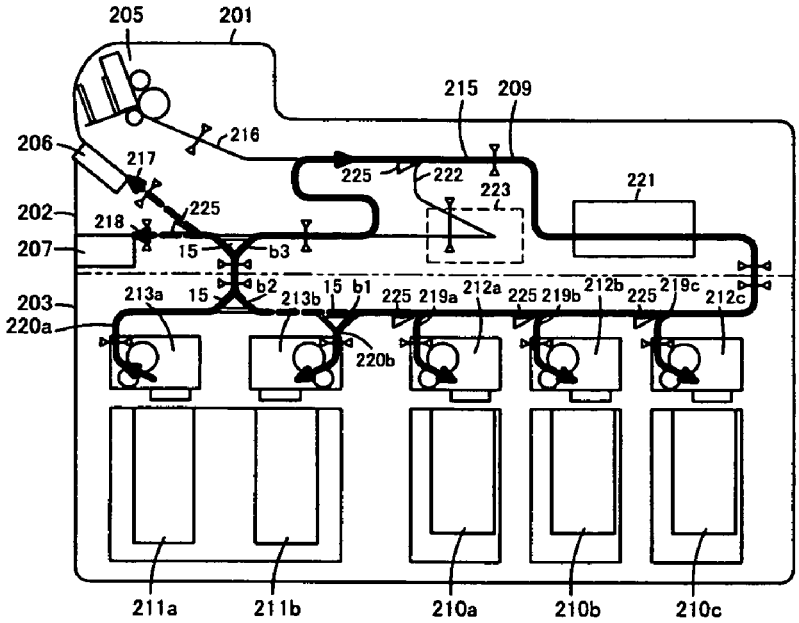
FIG. 26 shows an initial replenishment process of the above-described paper sheet processing apparatus, FIG. 26(*a*) is an explanatory view showing an initial replenishment process from one cassette, and FIG. 26(*b*) is an explanatory view showing an initial replenishment process from another cassette.
Figure 26:
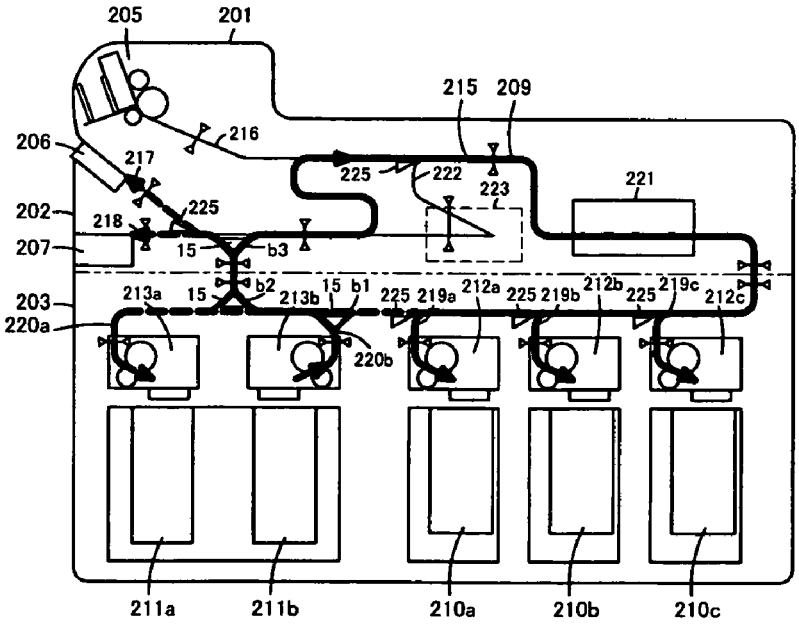

As shown in FIG. 26(*a*), in replenishment operation by the one cassette 211*a*, banknotes stored in the one cassette 211*a* are fed one by one from the escrow unit 213*a* to the cassette transport path 220*a*, sent in the normal direction to the loop-shaped transport path 215 via the diverter 15 at the diversion position b1, transported in the normal direction in the loop-shaped transport path 215, transported to the recognition unit 221 via the respective diverters 15 at the diversion positions b2 and b3, and recognized by the recognition unit 221.

Banknotes recognized as normal as a result of recognition are diverted, for each denomination, from the loop-shaped transport path 215 to the stacker transport paths 219*a* to 219*c* via the two-directional diverters 225 and sent to the denomination-specific escrow units 212*a* to 212*c*. Every time a predetermined quantity of banknotes is escrowed in the escrow units 212*a* to 212*c*, the banknotes are stored in the stackers 210*a* to 210*c* located below.

When banknotes cannot be performed for a predetermined recognition operation by the recognition unit 221 and are recognized as re-recognizable banknotes which may be recognized as normal by re-recognition, the re-recognizable banknotes are diverted from the loop-shaped transport path 215 to the cassette transport path 220*b* via the diverter 15 at the diversion position b1, and escrowed in the escrow unit 213*b* in the stacked state.

In addition, when banknotes are recognized as rejected banknotes which are not normal and un-re-recognizable by the recognition unit 221, the feeding from the escrow unit 213*a* is temporarily stopped, the rejected banknotes are diverted from the loop-shaped transport path 215 to the dispensing and transport path 217 or the reject transport 218 via the respective diverters 15 at the diversion positions b1, b2 and b3 and the two-directional diverter 225, and sent to the outlet 206 or the reject box 207.

In the replenishment operation from the one cassette 211*a*, the diverter 15 at the diversion position b1 performs the high-speed diversion operation by the diversion control to divert re-recognizable banknotes to the cassette transport path 220*b* and make the rejected banknotes pass through to the downstream side of the loop-shaped transport path 215.

When re-recognizable banknotes are escrowed in the escrow unit 213*b*, the re-recognition operation similar to that in the depositing process shown in FIG. 24(*b*) is performed after the banknotes are completely fed from the one cassette 211*a*.

Additionally, as shown in FIG. 26(*b*), replenishment operation by the other cassette 211*b* is similar to that from the one cassette 211*a*. In this case, the banknotes stored in the other cassette 211*b* are fed one by one from the escrow unit 213*b* to the cassette transport path 220*b*, sent in the normal direction to the loop-shaped transport path 215 via the diverter 15 at the diversion position b1, and transported in the normal direction in the loop-shaped transport path 215.

Banknotes recognized as normal as a result of recognition are diverted, for each denomination, from the loop-shaped transport path 215 to the stacker transport paths 219*a* to 219*c* via the two-directional diverters 225 and sent to the denomination-specific escrow units 212*a* to 212*c*. Every time the predetermined quantity of banknotes is escrowed in the escrow units 212*a* to 212*c*, the banknotes are stored in the stackers 210*a* to 210*c* located below.

When banknotes cannot be performed for a predetermined recognition operation by the recognition unit 221 and are recognized as re-recognizable banknotes which may be recognized as normal by re-recognition, the re-recognizable banknotes are diverted from the loop-shaped transport path 215 to the cassette transport path 220*a* via the diverter 15 at the diversion position b2, and escrowed in the escrow unit 213*a* in the stacked state.

In addition, when banknotes are recognized as rejected banknotes which are not normal and un-re-recognizable by the recognition unit 221, the feeding from the escrow unit 213*b* is temporarily stopped, the rejected banknotes are diverted from the loop-shaped transport path 215 to the dispensing and transport path 217 or the reject transport 218 via the respective diverters 15 at the diversion positions b1, b2 and b3 and the two-directional diverter 225, and sent to the outlet 206 or the reject box 207.

In the replenishment operation from the other cassette 211*b*, the diverter 15 at the diversion position b2 performs the high-speed diversion operation by the diversion control to divert the re-recognizable banknotes to the cassette transport path 220*a* and make the rejected banknotes pass through to the downstream side of the loop-shaped transport path 215.

Next, an automatic replenishment process will be described with reference to FIG. 27.

The automatic replenishment process is automatically performed when, for example, the dispensing process continues and the quantity of banknotes stored in the stackers 210*a* to 210*c* decreases.

Figure 27:
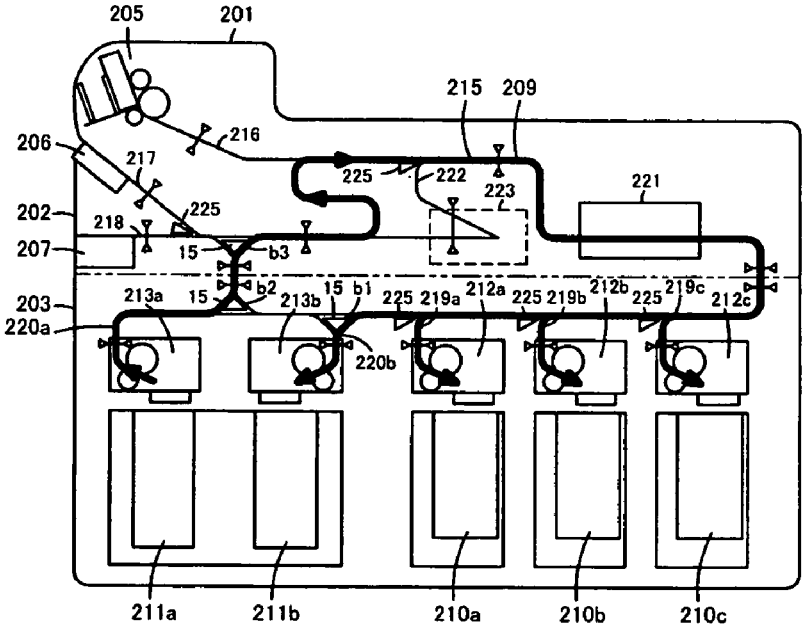
FIG. 27 shows an automatic replenishment process of the above-described paper sheet processing apparatus, FIG. 27(*a*) is an explanatory, view showing an automatic replenishment process from one cassette, and FIG. 27(*b*) is an explanatory view showing movement of a banknote from one cassette to another cassette.
Figure 27:
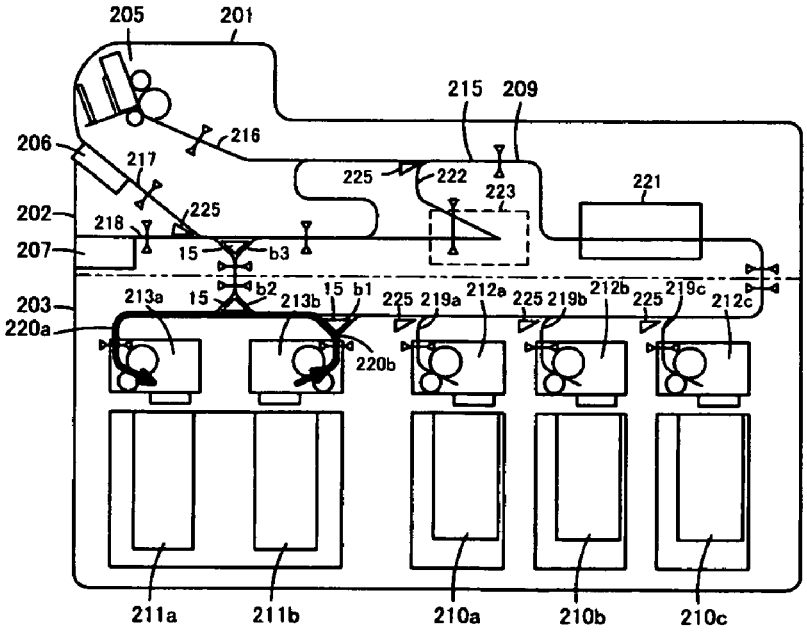

As shown in FIG. 27(*a*), when banknotes are stored in the one cassette 211*a*, the replenishment operation from the one cassette 211*a* is performed first. The banknotes stored in the one cassette 211*a* are fed one by one from the escrow unit 213*a* to the cassette transport path 220*a*, sent in the normal direction to the loop-shaped transport path 215 via the diverter 15 at the diversion position b1, transported in the normal direction in the loop-shaped transport path 215, transported to the recognition unit 221 via the respective diverters 15 at the diversion positions b2 and b3, and recognized by the recognition unit 221.

Banknotes recognized as normal as a result of recognition are diverted, for each denomination, from the loop-shaped transport path 215 to the stacker transport paths 219*a* to 219*c* via the two-directional diverters 225 and sent to the denomination-specific escrow units 212*a* to 212*c*. Every time the predetermined quantity of banknotes is escrowed in the escrow units 212*a* to 212*c*, the banknotes are stored in the stackers 210*a* to 210*c* located below.

When re-recognizable banknotes for which a predetermined recognition operation cannot be performed by the recognition unit 221 and may be recognized as normal by re-recognition or un-re-recognizable rejected banknotes are recognized, these banknotes are diverted from the loop-shaped transport path 215 to the cassette transport path 220*b* via the diverter 15 at the diversion position b1, and escrowed in the escrow unit 213*b* in the stacked state.

When, for example, banknotes in the one cassette 211*a* are used up and banknotes stored in the other cassette 211*b* are required to be replenished, as shown in FIG. 27(*b*), the banknotes stored in the other cassette 211*b* are fed one by one from the escrow unit 213*b* to the cassette transport path 220*b*, sent in the normal direction to the loop-shaped transport path 215 via the diverter 15 at the diversion position b1, transported in the normal direction in the loop-shaped transport path 215, diverted to the cassette transport path 220*a* via the diverter 15 at the diversion position b2, and stored in the one cassette 211*a*. That is, banknotes stored in the other cassette 211*b* are moved to the one cassette 211*a*, and then the replenishment operation from the one cassette 211*a* is performed as described above.

The automatic replenishment process is thus performed after the banknotes stored in the other cassette 211*b* are moved to the one cassette 211*a*, in the case where banknotes cannot be recognized by the recognition unit 221, the banknotes can be stored in the other cassette 211*b* and the banknotes are smoothly transported without interruption.

Next, a collecting process will be described with reference to FIG. 28.

In the collecting process, banknotes stored in the unit body 201 are collected in the cassettes 211*a* and 211*b* after recognition.

It is assumed here that the one cassette 211*a* is empty due to the replenishment process. As shown in FIG. 28(*a*), first, the banknotes stored in the other cassette 211*b* are fed one by one from the escrow unit 213*b* to the cassette transport path 220*b*, sent in the reverse direction to the loop-shaped transport path 215 via the diverter 15 at the diversion position b1, transported in the reverse direction of the loop-shaped transport path 215 and recognized by the recognition unit 221.

Banknotes recognized as normal as a result of recognition are, if necessary, located so that the front or back of the banknotes faces in the predetermined direction by the face/back reversing unit 223, diverted from the loop-shaped transport path 215 to the cassette transport path 220*a* via the diverter 15 at the diversion position b2 and escrowed in the escrow unit 213*a*. Every time a predetermined quantity of banknotes is escrowed in the escrow unit 213*a*, the banknotes are stored in the one cassette 211*a*.

In addition, when banknotes are recognized as re-recognizable or un-re-recognizable rejected banknotes, these rejected banknotes are diverted from the loop-shaped transport path 215 to the reject transport path 218 via the diverter 15 at the diversion position b3 and the two-directional diverter 225, and sent to the reject box 207 for storing.

In the collecting process, the diverter 15 at the diversion position b3 performs the high-speed diversion operation by the diversion control to divert rejected banknotes to the reject transport path 218 and to make normal banknotes pass through to the downstream side of the loop-shaped transport path 215.

Figure 28:
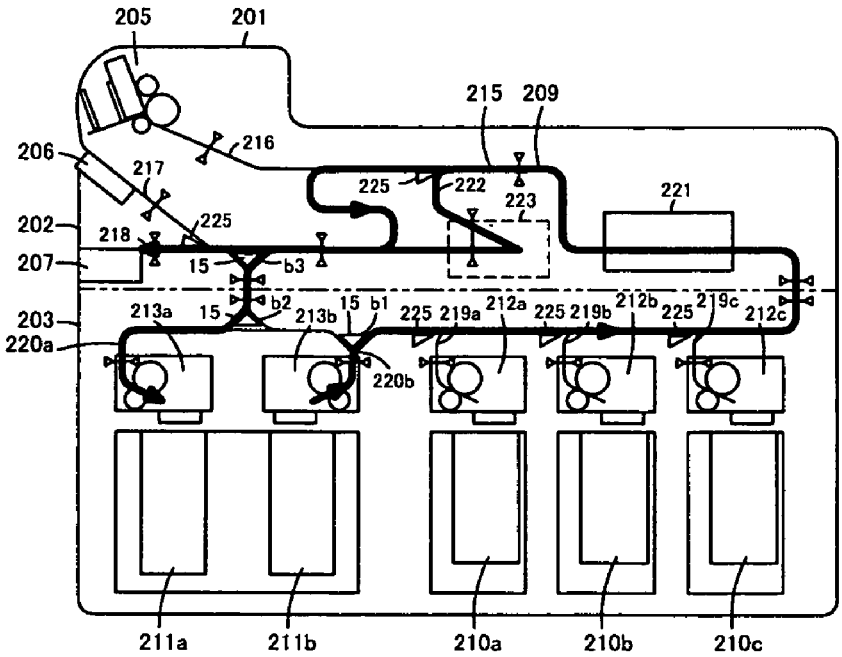
FIG. 28 shows a collecting process of the above-described paper sheet processing apparatus, FIG. 28(*a*) is an explanatory view showing a collecting process from another cassette, FIG. 28(*b*) is an explanatory view showing a collecting process from a stacker.
Figure 28:
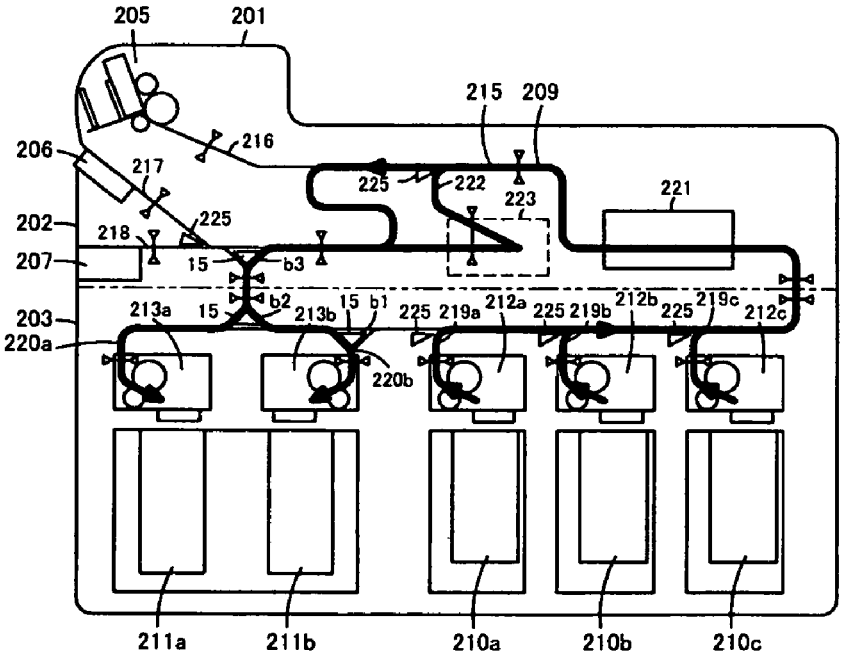

After banknotes stored in the other cassette 211*b* are completely collected, the collecting process from the respective stackers 210*a* to 210*c* is next performed as shown in FIG. 28(*b*). Although the collecting process from the respective stackers 210*a* to 210*b* is similar to that from the other cassette 211*b*, a collection destination of banknotes is switched to the other cassette 211*b* by the diverter 15 at the diversion position b2 when the one cassette 211*a* is filled with banknotes in the middle of the collecting process.

Next, another example of a paper sheet processing apparatus adopting the diverter 15 will be described with reference to FIGS. 29 to 32.

Figure 29:
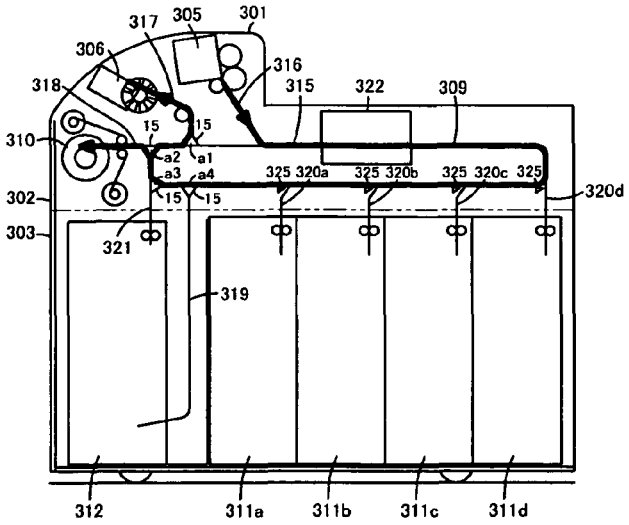
FIG. 29 shows an inner structure of another example of a paper sheet processing apparatus to which the diverters are applied, FIG. 29(*a*) is an explanatory view showing a counting operation of a depositing process, FIG. 29(*b*) is an explanatory view showing a storage operation of the depositing process, and FIG. 29(*c*) is an explanatory view showing a return operation of the depositing process.
Figure 29:
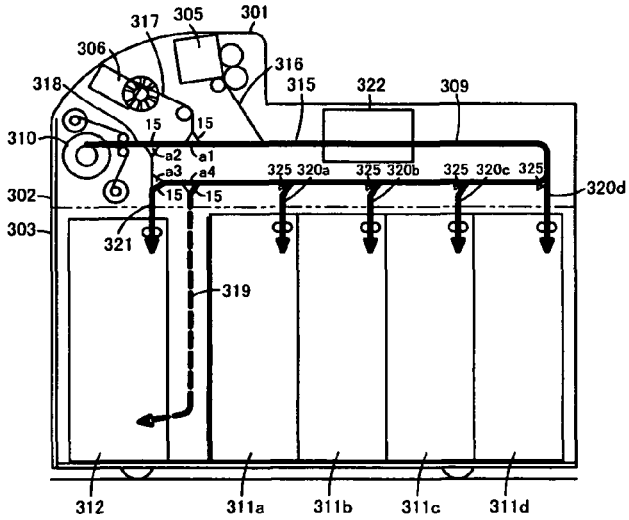
Figure 29:
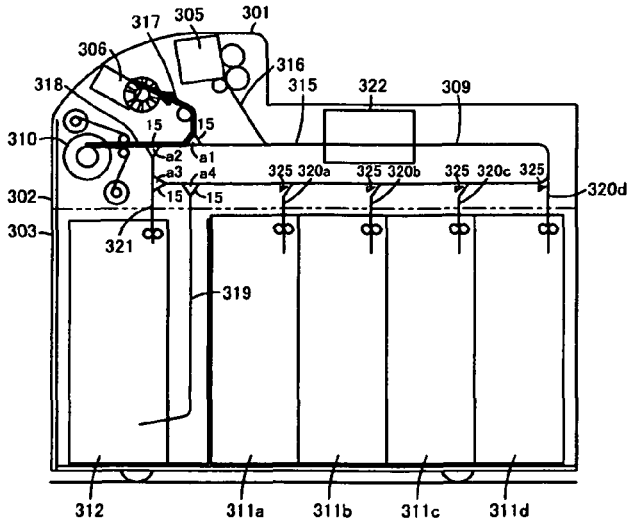

As shown in FIG. 29, the paper sheet processing apparatus is a banknote depositing and dispensing unit for depositing and dispensing banknotes, for example. The banknote depositing and dispensing unit includes an upper unit 302 and a lower unit 303 which can be drawn out from the front face of a unit body 301.

An inlet 305 for depositing banknotes and an outlet 306 for dispensing banknotes are disposed at an upper portion of a front face of the upper unit 302.

In the upper unit 302, a transport unit 309 for transporting banknotes and an escrow unit 310 for escrowing banknotes with the banknotes separated one by one are disposed. In the lower unit 303, stackers 311*a* to 311*d* for storing banknotes for each denomination are juxtaposed in the back-forth direction, and a cassette 312 for storing banknotes is disposed at the front side of the stackers 311*a* to 311*d*. In the cassette 312, a reject storing unit (not shown) for storing rejected banknotes is provided.

The transport unit 309 is constituted by a belt mechanism, roller mechanism, etc., for transporting banknotes, and has a loop-shaped transport path 315 in which banknotes can be bidirectionally transported. In the loop-shaped transport path 315, a direction in which banknotes are transported clockwise in FIG. 29 is called "normal direction," and a direction in which banknotes are transported counterclockwise in FIG. 29 is called "reverse direction." To the loop-shaped transport path 315, a deposit and transport path 316 from the inlet 305, a dispensing and transport path 317 to the outlet 306, an escrow transport path 318 to and from the escrow unit 310, a reject transport path 319 to a reject unit, stacker transport paths 320*a* to 320*d* to and from the respective stackers 311*a* to 311*d*, and a cassette transport path 321 to and from the cassette 312 are connected. Additionally, a recognition unit 322 for recognizing transported banknotes is disposed between the deposit and transport path 316 and the rearmost stacker transport path 320*d* in the loop-shaped transport path 315.

On the loop-shaped transport path 315, the respective diverters 15 having either one of the constitutions of the diverter 15 used in the embodiments described above are disposed at a diversion positional between the dispensing and transport path 317, a diversion position a2 between the escrow transport path, a diversion position a3 between the cassette transport path 321 and a diversion position a4 to the reject transport path 319. The diversion positions a1 to a4 are arranged relatively near each other and, for example, circumferentially, and the third example of the driving method using the plurality of diverters 15 shown in FIG. 20 or the fourth example of the driving method using the plurality of diverters 15 shown in FIG. 22 are disposed. Additionally, a common two-directional diverter 325 is disposed at the respective diversion positions between the loop-shaped transport path 315 and the respective stacker transport paths 320*a* to 320*d*. Moreover, in the respective diverters 15, any two of the first transport path 11, the second transport path 12 and the third transport path 13 shown in FIG. 1 correspond to the loop-shaped transport path 315 and the other path corresponds to the dispensing and transport path 317, the escrow transport path 318, the cassette transport path 321 and the reject transport path 319 viewed from the respective diversion positions a1 to a4.

Next, a depositing process of the banknote depositing and dispensing unit will be described with reference to FIGS. 29(*a*) to (*c*) (a main transport path of banknotes is indicated by a bold line).

Banknotes input in the inlet 305 are sent one by one in the normal direction to the loop-shaped transport path 315 from the deposit and transport path 316, transported in the normal direction of the loop-shaped transport path 315 and recognized by the recognition unit 322.

Banknotes recognized as normal by the recognition unit 322 are diverted from the loop-shaped transport path 315 to the escrow transport path 318 via the diverter 15 at the diversion position a2, and escrowed in the escrow unit 310 in a separated state.

Rejected banknotes for which a predetermined recognition operation cannot be performed because the transported banknotes are stacked, or banknotes recognized as rejected banknotes which are not normal and un-re-recognizable by the recognition unit 322 are diverted from the loop-shaped transport path 315 to the dispensing and transport path 317 via the diverter 15 at the diversion positional, and sent to the outlet 306 for returning.

Here, the respective diverters 15 are subject to the direction control so that the acute tip 22 of the diversion member 21 turns toward the upstream side in the normal direction of the loop-shaped transport path 315 (see FIG. 20(*b*) or FIG. 22(*b*)), and the diverter 15 at the diversion position a2 performs the high-speed diversion operation by the diversion control to divert banknotes to be escrowed to the escrow transport path 318 and to make the rejected banknotes pass through to the downstream side of the loop-shaped transport path 315.

When a depositing storing instruction is issued after banknotes input in the inlet 305 are completely escrowed, as shown in FIG. 29(*b*), banknotes escrowed in the escrow unit 310 are fed one by one to the escrow transport path 318, sent in the normal direction to the loop-shaped transport path 315 via the diverter 15 at the diversion position a2, transported in the normal direction of the loop-shaped transport path 315 and recognized by the recognition unit 322.

Banknotes recognized as normal as a result of recognition are diverted from the loop-shaped transport path 315 to the respective stacker transport paths 320*a* to 320*d* via the respective denomination-specific two-directional diverters 325, and stored in the denomination-specific stackers 311*a* to 311*d*.

Overflow banknotes of denominations being full in the stackers 311*a* to 311*d* are diverted from the loop-shaped transport path 315 to the cassette transport path 321 via the diverter 15 at the diversion position a3, and stored in the cassette 312.

Rejected banknotes for which a predetermined recognition operation cannot be performed, or banknotes recognized as rejected banknotes which are not normal and un-re-recognizable by the recognition unit 322 are diverted from the loop-shaped transport path 315 to the reject transport path 319 via the diverter 15 at the diversion position a4, and sent to the reject unit of the cassette 312 for storing.

When a deposit return instruction is issued, as shown in FIG. 29(*c*), banknotes escrowed in the escrow unit 310 are fed one by one to the escrow transport path 318, sent in the normal direction to the loop-shaped transport path 315 via the diverter 15 at the diversion position a2, transported in the normal direction in the loop-shaped transport path 315, diverted from the loop-shaped transport path 315 to the dispensing and transport path 317 via the diverter 15 at the diversion position a1, and sent to the outlet 206 for returning.

Here, for the state of the respective diverters 15, only the diverter 15 at the diversion position a2 is subject to the direction control so that the acute tip 22 of the diversion member 21 turns toward the downstream side in the normal direction of the loop-shaped transport path 315 (see the state shown in FIG. 20(*c*) or FIG. 22(*c*)), thereby banknotes to be returned transported from the escrow transport path 318 can be sent in the normal direction of the loop-shaped transport path 315.

Figure 30:
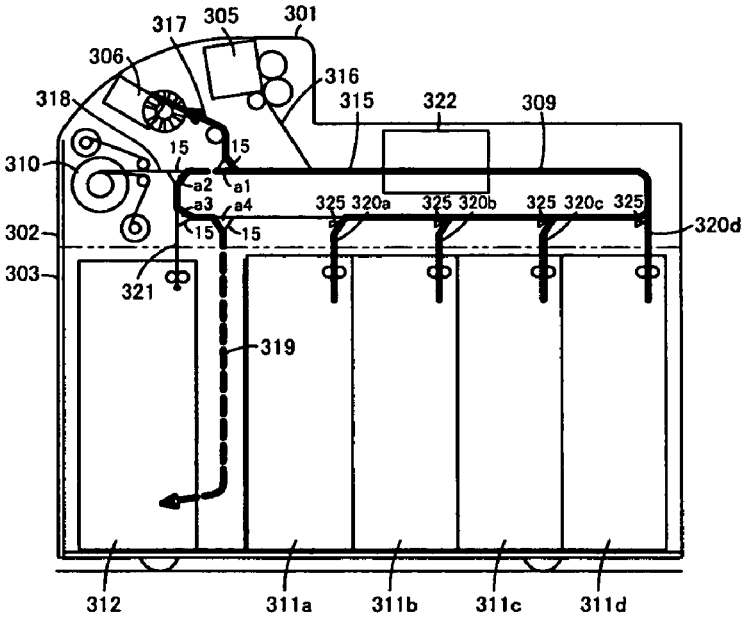
FIG. 30 is an explanatory view showing a dispensing process of the above-described paper sheet processing apparatus.

Next, a dispensing process will be described with reference to FIG. 30.

In the dispensing process, banknotes stored in the stackers 311*a* to 311*d* of the denominations to be dispensed are fed one by one to the stacker transport paths 320*a* to 320*c*, sent in the reverse direction to the loop-shaped transport path 315, transported in the reverse direction of the loop-shaped transport path 315 and recognized by the recognition unit 322.

Banknotes recognized as normal as a result of recognition are diverted from the loop-shaped transport path 315 to the dispensing and transport path 317 via the diverter 15 at the diversion positional, and sent and dispensed to the outlet 306 for dispensing.

Rejected banknotes for which a predetermined recognition operation cannot be performed by the recognition unit 322 because the transported banknotes are stacked, or banknotes recognized as rejected banknotes which are not normal and un-re-recognizable by the recognition unit 322 are diverted from the loop-shaped transport path 315 to the reject transport path 319 via the diverter 15 at the diversion position a4, and sent to the reject unit of the cassette 312 for storing.

Here, the respective diverters 15 are subject to the direction control so that the acute tip 22 of the diversion member 21 turns toward the upstream side in the reverse direction of the loop-shaped transport path 315 (see FIG. 20(*a*) or FIG. 22(*a*)), and the diverter 15 at the diversion positional performs the high-speed diversion operation by the diversion control to divert banknotes to be dispensed to the dispensing and transport path 317 and to make the rejected banknotes pass through to the downstream side in the reverse direction of the loop-shaped transport path 315.

Additionally, banknotes of an insufficient denomination due to the occurrence of rejected banknotes are re-fed from the corresponding stackers 311*a* to 311*d*.

Figure 31:
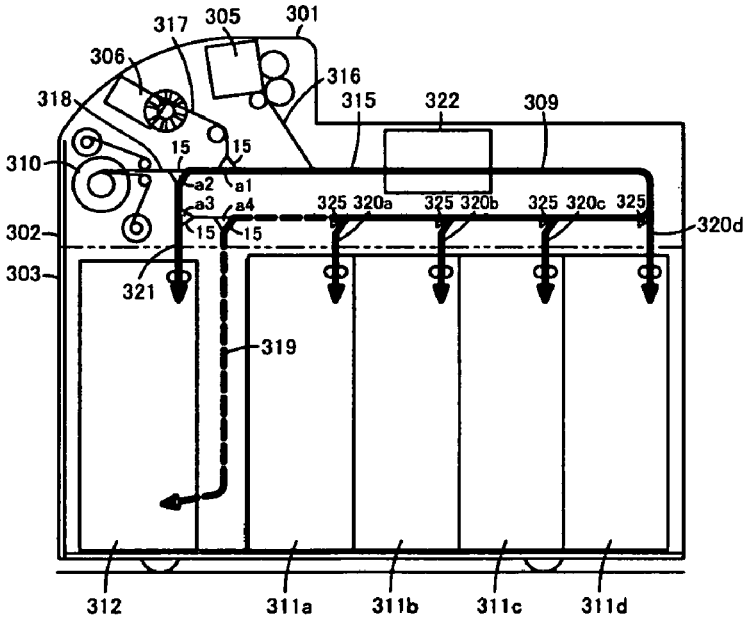
FIG. 31 is an explanatory view showing a replenishment process of the above-described paper sheet processing apparatus.

Next, a replenishment process will be described with reference to FIG. 31.

Banknotes stored in the cassette 312 are fed one by one to the cassette transport path 321, sent in the normal direction to the loop-shaped transport path 315 via the diverter 15 at the diversion position a3, transported in the normal direction in the loop-shaped transport path 315 and recognized by the recognition unit 322.

Banknotes recognized as normal as a result of recognition are diverted from the loop-shaped transport path 315 to the stacker transport paths 320*a* to 320*d* via the denomination-specific two-directional diverters 325, and stored in the denomination-specific stackers 311*a* to 311*d*.

Rejected banknotes for which a predetermined recognition operation cannot be performed by the recognition unit 221 because the transported banknotes are stacked, or banknotes recognized as rejected banknotes which are not normal and un-re-recognizable by the recognition unit 322 are diverted from the loop-shaped transport path 315 to the reject transport path 319 via the diverter 15 at the diversion position a4, and sent to the reject unit of the cassette 312 for storing.

Here, because the high-speed diversion operation is not necessary, the respective diverters 15 may be subject to the direction control so that the acute tip 22 of the diversion member 21 tuns toward the downstream side in the normal direction of the loop-shaped transport path 315 (see FIG. 20(*a*) or FIG. 22(*a*)), or may be subject to the direction control so that the acute tip 22 of the diversion member 21 turns toward the upstream side in the normal direction of the loop-shaped transport path 315 (see FIG. 20(*b*) or FIG. 22(*b*)).

Figure 32:
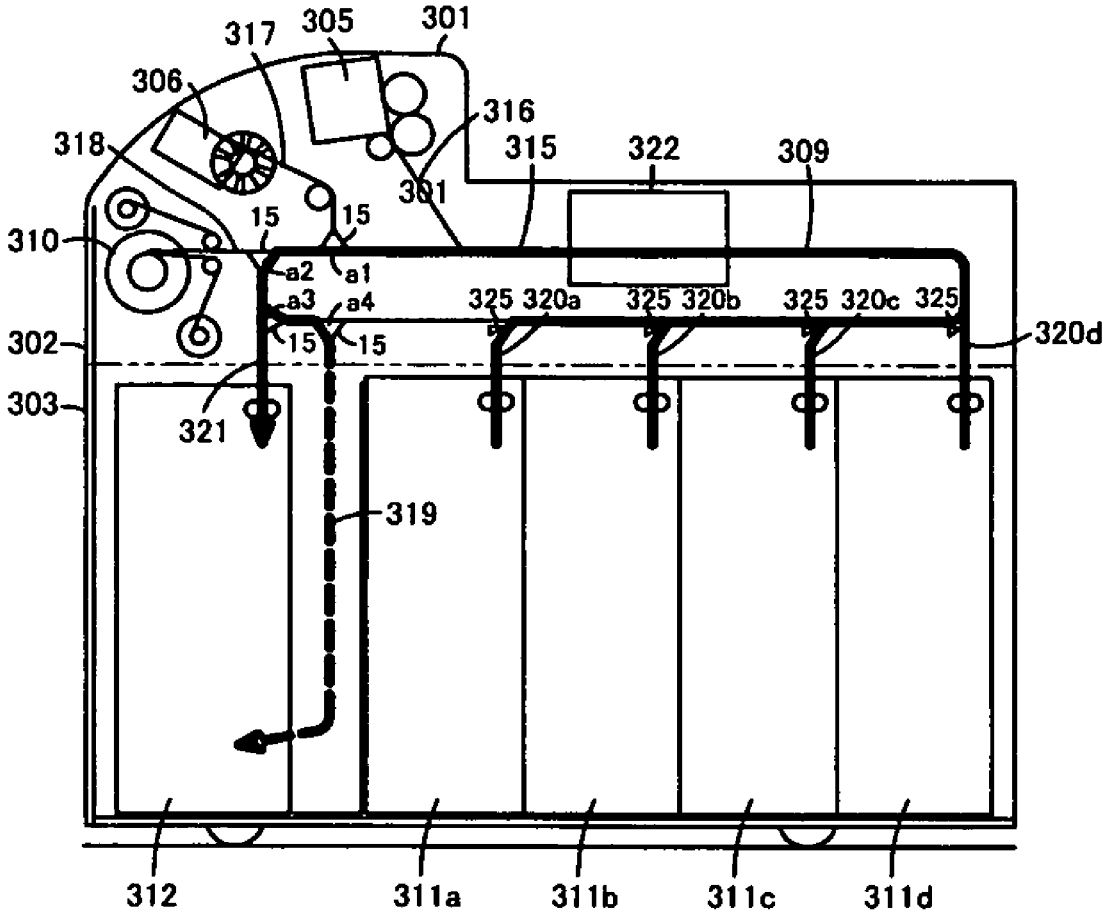
FIG. 32 is an explanatory view showing a collecting process of the above-described paper sheet processing apparatus.

Next, a collecting process will be described with reference to FIG. 32.

In the collecting process, banknotes stored in the stackers 311*a* to 311*d* are collected in the cassette 312 after recognition.

Banknotes stored in the stackers 311*a* to 311*d* are fed one by one, in order by the denomination, to the stacker transport paths 320*a* to 320*c*, sent in the reverse direction to the loop-shaped transport path 315, transported in the reverse direction in the loop-shaped transport path 315 and recognized by the recognition unit 322.

Banknotes recognized as normal as a result of recognition are diverted from the loop-shaped transport path 315 to the cassette transport path 321 via the diverter 15 at the diversion position a3, and sent to the cassette 312 for storing.

Rejected banknotes for which a predetermined recognition operation cannot be performed by the recognition unit 322 because the transported banknotes are stacked, or banknotes recognized as rejected banknotes which are not normal and un-re-recognizable by the recognition unit 322 are diverted from the loop-shaped transport path 315 to the reject transport path 319 via the diverter 15 at the diversion position a4, and sent to the reject unit of the cassette 312 for storing.

Here, the respective diverters 15 are subject to the direction control so that the acute tip 22 of the diversion member 21 turns toward the upstream side in the reverse direction of the loop-shaped transport path 315 (see FIG. 20(*a*) or FIG. 22(*a*)), and the diverter 15 at the diversion position a3 performs the high-speed diversion operation by the diversion control to divert banknotes to be collected in the cassette 312 to the cassette transport path 321 and make the rejected banknotes pass through to the downstream side in the reverse direction of the loop-shaped transport path 315.

The diverter 15 capable of performing the high-speed diversion operation is adopted at the respective diversion positions for transporting banknotes between the transport paths in three directions as shown in the example of the respective banknote depositing and dispensing units, thereby the number of diverters can be reduced and a transport path can be simplified and downsized.

Moreover, although the diverter for diverting banknotes between the transport paths in three directions is described in the respective embodiments, a diverter for diverting banknotes between transport paths in multiple directions, for example, four directions or five directions can be adopted.

Industrial Applicability

The present invention is used for a paper sheet diverter for paper sheets such as banknotes, checks, vouchers and sheets, and for a paper sheet processing apparatus for processing such paper sheets.

The invention claimed is:

1. A paper sheet diverter comprising:

a diversion member which is rotatably provided at a junction portion of transport paths in at least three directions for transporting paper sheets has an external shape with one end that tapers off to form a tip and another end that is wider, the diversion member including transport faces for transporting paper sheets provided at both side faces of the diversion member from one end to the other end;

a driving unit for rotationally moving the diversion member; and a control unit for controlling the driving unit to make the diversion member rotationally move to at least three stopping positions including a first stopping position connecting a first transport path and a second transport path with the tip of the diversion member toward the first transport path to form a first transport passage, a second stopping position connecting the first transport path and a third transport path with the tip of the diversion member toward the first transport path to form a second transport passage and a third stopping position connecting transport paths other than the first transport path with the tip of the diversion member toward one of the second and third transport path to form a third transport passage, wherein a rotation time of the diversion member between the first stopping position and the second stopping position is shorter than that between the first stopping position and the third stopping position and that between the second stopping position and the third stopping position.

2. A paper sheet processing apparatus comprising:

a transport unit for transporting paper sheets between transport paths in at least three directions; and the paper sheet diverter according to claim 1 which is provided in the transport unit.

3. The paper sheet diverter comprising:

a diversion member which is rotatably provided at a junction portion of transport paths in at least three directions for transporting paper sheets has an external shape with one end that tapers off to form a tip and another end that is wider, the diversion member including transport faces for transporting paper sheets provided at both side faces of the diversion member from one end to the other end;

a driving unit for rotationally moving the diversion member; and a control unit for controlling the driving unit to make the diversion member rotationally move to at least three stopping positions including a first stopping position connecting a first transport path and a second transport path with the tip of the diversion member toward the first transport path to form a first transport passage, a second stopping position connecting the first transport path and a third transport path with the tip of the diversion member toward the first transport path to form a second transport passage and a third stopping position connecting transport paths other than the first transport path with the tip of the diversion member toward one of the second or third transport path to form a third transport passage, wherein a rotation angle of the diversion member between the first stopping position and the second stopping position is smaller than that between the first stopping position and the third stopping position and that between the second stopping position and the third stopping position.

4. A paper sheet processing apparatus comprising:

a transport unit for transporting paper sheets between transport paths in at least three directions; and the paper sheet diverter according to claim 3 which is provided in the transport unit.

5. A paper sheet diverter comprising:

a diversion member which is rotatably provided at a junction portion of transport paths in at least three directions for transporting paper sheets has an external shape with one end that tapers off to form a tip and another end that is wider, the diversion member including transport faces for transporting paper sheets provided at both side faces of the diversion member from one end to the other end;

a driving unit for rotationally moving the diversion member; and a control unit for controlling the driving unit to make the diversion member rotationally move and performing diversion control for switching two transport passages formed by the one transport path and two other transport paths with the tip of the diversion member toward one transport path and direction control for switching transport paths to be subject to the diversion control with the tip of the diversion member toward one of the other transport paths from the one transport path, wherein a rotation time of the diversion member in the diversion control is shorter than that in the direction control.

6. The paper sheet diverter according to claim 5, wherein a rotation angle of the diversion member in the diversion control is smaller than that in the direction control.

7. The paper sheet diverter according to claim 5, wherein the driving unit includes a driving portion for rotationally moving the diversion member and a positioning unit for applying rotational resistance at a stopping position of the diversion member.

8. The paper sheet diverter according to claim 5, wherein the driving unit includes a diversion control driving unit for rotationally moving the diversion member in accordance with the diversion control and a direction control driving unit for rotationally moving the diversion member in accordance with the direction control.

9. The paper sheet diverter according to claim 8, wherein the diversion control driving unit regulates the rotational range of the diversion member between two positions for switching two transport passages with respect to one transport path to make the diversion member rotationally move between the two positions in accordance with the diversion control.

10. The paper sheet diverter according to claim 8, wherein the direction control driving unit includes a rotation body rotationally moving together with the diversion member via the diversion control driving unit and a driving portion for rotationally moving the rotation body.

11. The paper sheet diverter according to claim 8, wherein the direction control driving unit includes a driving portion for rotationally moving the diversion member to switch the transport paths to be subject to the diversion control via the diversion control driving unit.

12. The paper sheet diverter according to claim 8, wherein the direction control driving unit includes: a locking unit for locking the diversion member which has switched transport paths to be subject to the diversion control at the respective stopping positions; a switch body for rotationally moving the diversion member to switch transport paths to be subject to the diversion control via the diversion control driving unit; and a driving portion for driving the switch body.

13. The paper sheet diverter according to claim 8, wherein the direction control driving unit includes: a rotatable cam; a contact which moves along a cam face of the cam and rotationally moves the diversion member via the diversion control driving unit; and a driving portion for rotationally moving the cam.

14. A paper sheet processing apparatus comprising:

a transport unit for transporting paper sheets between transport paths in at least three directions; and the paper sheet diverter according to claim 5 which is provided in the transport unit.

15. A paper sheet diverting method for rotationally moving a diversion member provided at a junction portion of transport paths in at least three directions for transporting paper sheets to switch transport passages of paper sheets, wherein a diversion member has an external shape with one end that tapers off to form a tip and another end that is wider, the diversion member including transport faces for transporting paper sheets provided at both side faces of the diversion member from one end to the other end;

the diversion member is rotationally moved with the tip of the diversion member toward one of the transport paths by diversion control to divert paper sheets, which are continuously transported from the one transport path, to the two other transport paths, the diversion member is rotationally moved with the tip of the diversion member toward one of the other transport paths from the one transport path by direction control to switch the transport paths to be subject to the diversion control, and a rotation time of the diversion member in the diversion control is shorter than that in the direction control.

16. A paper sheet diverting method for rotationally moving a diversion member provided at a junction portion of transport paths in at least three directions for transporting paper sheets to switch transport passages of paper sheets, wherein a diversion member has an external shape with one end that tapers off to form a tip and another end that is wider, the diversion member including transport faces for transporting paper sheets provided at both side faces of the diversion member from one end to the other end;

the diversion member is rotationally moved with the tip of the diversion member toward one of the transport paths by diversion control to divert paper sheets, which are continuously transported from the one transport path, to the two other transport paths, the diversion member is rotationally moved with the tip of the diversion member toward one of the other transport paths from the one transport path by direction control to switch the transport paths to be subject to the diversion control, and a rotation angle of the diversion member in the diversion control is smaller than that in the direction control.

* * * * *